US009902187B2

(12) United States Patent
Holmes

(10) Patent No.: US 9,902,187 B2
(45) Date of Patent: Feb. 27, 2018

(54) SECURITY DEVICES AND METHODS OF MANUFACTURE THEREOF

(71) Applicant: DE LA RUE INTERNATIONAL LIMITED, Hampshire (GB)

(72) Inventor: Brian Holmes, Hampshire (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 255 days.

(21) Appl. No.: 14/762,091

(22) PCT Filed: Feb. 3, 2014

(86) PCT No.: PCT/GB2014/050284

§ 371 (c)(1),
(2) Date: Jul. 20, 2015

(87) PCT Pub. No.: WO2014/118569

PCT Pub. Date: Aug. 7, 2014

(65) Prior Publication Data

US 2015/0352887 A1 Dec. 10, 2015

(30) Foreign Application Priority Data

Feb. 1, 2013 (GB) ..... 1301790.0

(51) Int. Cl.
*B42D 25/324* (2014.01)
*B42D 25/328* (2014.01)
(Continued)

(52) U.S. Cl.
CPC ..... *B42D 25/328* (2014.10); *B42D 25/00* (2014.10); *B42D 25/29* (2014.10); *B42D 25/351* (2014.10);
(Continued)

(58) Field of Classification Search
CPC . B42D 25/324; B42D 25/328; B42D 2033/24
See application file for complete search history.

(56) References Cited

U.S. PATENT DOCUMENTS 4,728,377 A 3/1988 Gallagher
5,629,068 A 5/1997 Miekka et al.
(Continued)

FOREIGN PATENT DOCUMENTS

CA 2163528 A1 4/1995
CA 2611195 A1 12/2006
(Continued)

OTHER PUBLICATIONS

Jun. 6, 2014 International Search Report issued in International Patent Application No. PCT/GB20141050284.
(Continued)

*Primary Examiner* — Kyle Grabowski
(74) *Attorney, Agent, or Firm* — Oliff PLC

(57) ABSTRACT

A security device is provided including a transparent layer having a first optically variable effect generating relief structure formed in a surface thereof; a reflection enhancing body extending over the first relief structure and following the contour of the first relief on a first side of the reflection enhancing body; and a second optically variable effect generating relief structure formed in a second side of the reflection enhancing body. The reflection enhancing body includes at least a first reflection enhancing layer defining the first and/or second sides of the reflection enhancing body and the first reflection enhancing layer includes a binder having reflective particles dispersed therein. When the device is viewed through the transparent layer, the optically variable effect of the first relief structure is visible and when the device is viewed from the other side, the optically variable effect of the second relief structure is visible.

37 Claims, 12 Drawing Sheets

(51) Int. Cl.

| | |
|---|---|
| ***B42D 25/351*** | (2014.01) |
| ***B42D 25/364*** | (2014.01) |
| ***B42D 25/36*** | (2014.01) |
| ***B42D 25/29*** | (2014.01) |
| ***B42D 25/00*** | (2014.01) |
| *B41M 3/14* | (2006.01) |

(52) U.S. Cl.

CPC ..... *B42D 25/36* (2014.10); *B42D 25/364* (2014.10); *B41M 3/14* (2013.01); *B42D 25/324* (2014.10); *B42D 2033/04* (2013.01); *B42D 2033/18* (2013.01); *B42D 2033/20* (2013.01)

(56) References Cited

U.S. PATENT DOCUMENTS

| | | | | |
|---|---|---|---|---|
| 5,714,213 | A | 2/1998 | Antes et al. | |
| 7,054,042 | B2 * | 5/2006 | Holmes | G03H 1/0252 359/2 |
| 8,363,323 | B2 * | 1/2013 | Holmes | G03H 1/0248 359/2 |
| 2005/0012326 | A1 * | 1/2005 | Keller | B42D 25/355 283/94 |
| 2005/0104364 | A1 * | 5/2005 | Keller | B42D 25/29 283/72 |
| 2006/0181077 | A1 * | 8/2006 | Kaule | B41M 3/148 283/72 |
| 2007/0114787 | A1 | 5/2007 | Heim | |
| 2007/0259288 | A1 | 11/2007 | Yokoyama | |
| 2009/0317595 | A1 | 12/2009 | Brehm et al. | |
| 2010/0045024 | A1 * | 2/2010 | Attner | B32B 29/06 283/72 |

FOREIGN PATENT DOCUMENTS

| | | | | |
|---|---|---|---|---|
| CA | 2717775 | A1 | 9/2009 | |
| DE | 102007019522 | A1 * | 10/2008 | B42D 25/328 |
| EP | 0229646 | A2 | 7/1987 | |
| EP | 1294576 | B1 | 9/2008 | |
| EP | 1567713 | B1 | 4/2009 | |
| EP | 2065766 | A1 | 6/2009 | |
| JP | 2004-122566 | A | 4/2004 | |
| JP | 2007-515311 | A | 6/2007 | |
| JP | 2007-299493 | A | 11/2007 | |
| JP | 2009-134093 | A | 6/2009 | |
| JP | 2009-134094 | A | 6/2009 | |
| JP | 2010-518432 | A | 5/2010 | |
| JP | 2012-226223 | A | 11/2012 | |
| WO | 2005/051675 | A2 | 6/2005 | |
| WO | 2006/059254 | A1 | 6/2006 | |
| WO | 2008/031170 | A1 | 3/2008 | |
| WO | 2008/135174 | A1 | 11/2008 | |
| WO | 2010/043846 | A1 | 4/2010 | |
| WO | 2010/049676 | A1 | 5/2010 | |
| WO | 2011/017741 | A1 | 2/2011 | |
| WO | 2011/057759 | A1 | 5/2011 | |
| WO | 2013/137223 | A1 | 9/2013 | |

OTHER PUBLICATIONS

Jun. 6, 2014 Written Opinion issued in International Patent Application No. PCT/GB2014/050284.

Jun. 28, 2013 Search Report issued in British Patent Application No. 1301790.0.

Jul. 25, 2014 Search Report issued in British Patent Application No. 1401762.8.

Nov. 7, 2017 Office Action issued in Japanese Patent Application No. 2015-555805.

* cited by examiner

SECURITY DEVICES AND METHODS OF MANUFACTURE THEREOF

This invention relates to security devices, suitable for establishing the authenticity of objects of value, particularly security documents, and their methods of manufacture. In particular, the invention relates to security devices incorporating optically variable effect generating relief structures such as holograms and diffraction gratings.

Optically variable effect generating relief structures such as holograms and diffraction gratings have been used widely over the last few years to impart security to documents of value such as banknotes, credit cards, passports and the like. Conventionally, the structure is provided on a transfer foil and then hot stamped from the transfer foil onto the final document substrate. An early example of this approach is described in U.S. Pat. No. 4,728,377.

More recently, such structures have been used in combination with transparent window features formed in the document substrate to allow the optically variable effect to be viewed through the document. The window may take the form of an aperture through one or more layers of the document substrate or may comprise an optically transparent region of the document substrate. An example of an optically variable effect generating relief structure located in a window region formed as an aperture in a document is given in CA-C-2163528. An example of an optically variable effect generating relief structure located in a window region formed as a transparent region of a document (here, a polymer banknote) is given in WO-A-2008/031170.

Placing a security device in a window has the advantage that the device can be viewed from both sides of the document. As such it is desirable that a secure visual effect is exhibited by both sides of the security device, in order to increase the difficulty of counterfeiting. Examples of devices in which both sides exhibit a secure effect are disclosed in CA-C-2163528, US-A-2005/0104364, US-A-2007/0114787, CA-A-2717775 and CA-A-2611195. However, there is an ever-present need to improve the security level of such devices in order to stay ahead of would-be counterfeiters.

In accordance with the present invention, a security device is provided comprising a transparent layer having a first optically variable effect generating relief structure formed in a surface thereof; a reflection enhancing body extending over the first relief structure and following the contour of the first relief on a first side of the reflection enhancing body; and a second optically variable effect generating relief structure formed in a second side of the reflection enhancing body, the reflection enhancing body comprising at least a first reflection enhancing layer defining the first and/or second sides of the reflection enhancing body, the first reflection enhancing layer comprising a binder having reflective particles dispersed therein, wherein when the device is viewed through the transparent layer, the optically variable effect of the first relief structure is visible and when the device is viewed from the other side, the optically variable effect of the second relief structure is visible.

Such a configuration enables the use of two different relief structures and hence different optical effects exhibited by each side of the device, as discussed further below. This is because only the first side of the reflection enhancing body conforms to the first relief structure, and a second (preferably different) relief structure is formed in its other side. Conventional techniques for achieving this result involve the use of two sequential metallisations: a first metal deposition to provide a reflective layer making a first relief structure visible, and a second metal deposition providing a second reflective layer making a second, subsequently formed, relief structure visible. However, the need for two metallisations leads to a complex and slow manufacturing process, and it is extremely difficult to register the metallisations to one another with a high degree of accuracy.

By using a reflection enhancing layer comprising a binder carrying a dispersion of reflective particles (e.g. metallic flakes, optically variable particles or optically variable magnetic particles) to provide one or both sides of the reflection enhancing body, the security device avoids the need for two metallisations since the reflective binder/particle layer provides the reflective characteristics needed to make at least one of the relief structures visible. As such the manufacturing process is considerably simplified. Moreover, since such material can be laid down in a highly controlled manner, using printing techniques for example, highly accurate register with the relief structures and with the device as a whole can be achieved. If for instance the reflection enhancing body consists solely of the first reflection enhancing layer, exact register between the optically variable effect area generated by the first relief structure and that generated by the second relief structure will be achieved automatically since both will be visible only in the region of the reflection enhancing layer. Generally, the "reflection enhancing body" is that portion of the device between the two relief structures in which the optically variable effect of one or both relief structures is made visible by virtue of the body's reflective characteristics.

As discussed below, the second optically variable effect generating relief structure is most advantageously providing by embossing or otherwise shaping the first reflection enhancing layer (optionally through an intervening layer) once it has been applied over the first relief structure. To enable this, the first reflection enhancing layer preferably comprises a material which is formable at least prior to curing. Other techniques for providing the two relief structures on either side of the reflection enhancing body are possible. The thickness of the reflection enhancing body should preferably be sufficient that the first and second relief structures do not interfere with each other, so that if desired the two relief structures can be different from one another and exhibit different effects without artefacts due to the other. To assist in this, in preferred embodiments, the reflection enhancing body has a thickness (in the direction perpendicular to the plane of the device) greater than the profile depths of each of the first and second relief structures. Most preferably, the thickness of the reflection enhancing body is equal to or greater than the sum of the maximum profile depths of the first and second relief structures (i.e. their maximum "amplitudes"). For example, typical diffractive relief structures such as holograms may have maximum profile depths of the order of 50 to 500 nm, more often between 80 and 150 nm. In contrast, the reflection enhancing body will preferably have a thickness of at least 0.3 microns and more typically at least 1 micron.

In particularly preferred implementations, the lateral extent of the reflection enhancing body is less than the full area of the security device. This emphasises the accurate registration between the two security effects visible from each side, since they will be bounded by transparent regions of the device and any misalignment in counterfeit versions would be clearly evident.

As mentioned above, the reflection enhancing body could consist solely of the first reflection enhancing layer. However, in particularly preferred embodiments, the first reflection enhancing layer defines one of the first and second sides of the reflection enhancing body, and the reflection enhancing body further comprises a second reflection enhancing layer defining the other of the first and second sides. This can be used for example to impart different reflective characteristics to the two relief structures. The reflection enhancing body could include additional layers between the first and second reflection enhancing layers if desired, which will not be visible in use. In a most preferred embodiment, the second reflection enhancing layer defines the first side of the reflection enhancing body and the first reflection enhancing layer defines the second side of the reflection enhancing body.

The first and second reflection enhancing layers could have different lateral extents. However, in particularly preferred embodiments, the lateral extent of the first reflection enhancing layer corresponds to that of the second reflection enhancing layer. In this way the two optically variable effects will be in precise register with one another, only the first reflection enhancing layer being visible from one side of the device and only the second reflection enhancing layer from the other. Particularly where the two reliefs give rise to two different optically variable effects, this can give the impression of two security devices in exact register whereas in fact this is achieved through a single device, or of a single device producing different effects from different viewpoints. The result is a striking visual impact which is very difficult to forge.

As discussed below this can be achieved with particularly good results by using the first reflection enhancing layer as a mask and removing those portions of the second reflection enhancing layer which are not covered by the first reflection enhancing layer, e.g. by etching. Hence, preferably, the first reflection enhancing layer comprises a resist material which is resistant to etchant suitable for removing material of the second reflection enhancing layer from the device.

Whether or not the reflection enhancing body comprises layers in addition to the first reflection enhancing layer, preferably the two surfaces of the first reflection enhancing layer follow different contours from one another. For example, where the first reflection enhancing layer provides both surfaces of the reflection enhancing body, preferably the two surfaces of the layer will carry different optically variable effect generating relief structures. Where only one of the surfaces of the first reflection enhancing layer provides one of the surfaces of the reflection enhancing body, that surface will be provided with an optically variable effect generating relief structure, whilst the other surface can follow any arbitrary contour (including planar), where it interfaces with another layer of the reflection enhancing body.

The first reflection enhancing layer can be of any composition suitable for providing the required reflective and formable properties discussed above but preferably comprises a polymeric binder having reflective particles dispersed therein, still preferably a reflective ink, most preferably a thermoplastic reflective ink. For example, the first reflection enhancing layer could comprise a polymer such as a vinyl resin containing reflective particles. The reflective particles could be metallic particles, optically variable particles (e.g. colour-shifting particles) or optically variable magnetic particles for example. Advantageously, the first reflection enhancing layer comprises a material with a forming temperature less than that of the transparent layer. That is, the temperature required in order to emboss or otherwise form the second relief structure into the first reflection enhancing layer is preferably below that at which the material of the transparent layer will soften or flow, such that the first relief structure is not damaged by the formation of the second. The first reflection enhancing layer may comprise for instance a thermoplastic polymeric binder. In preferred examples, the first reflection enhancing layer comprises a photoactive curing agent, preferably a UV curing agent.

The first reflection enhancing layer may be of uniform appearance all over. However in preferred examples, the complexity of the security device may be enhanced by introducing a pattern to this layer. Thus, preferably, the first reflection enhancing layer comprises two or more materials, each comprising a binder having reflective particles dispersed therein, the two or more materials being optically distinguishable (to the human eye or to a machine) from one another and arranged to define a pattern. For example, the first reflection enhancing layer could be laid down as a pattern of different materials each containing reflective particles, e.g. in one region the layer may contain aluminium particles, and in another region the layer may contain copper particles so as to give rise to a visible pattern. Alternatively the reflective particles may be the same throughout the layer but the material in which they are dispersed may be different, e.g. contain a different colourant as discussed below.

Most advantageously, the second reflection enhancing layer comprises one or more metals or alloys thereof, preferably copper, aluminium, nickel or chrome (or any alloys thereof). The use of a metal layer forming the first or second side of the reflection enhancing body results in a particularly bright replay of the optically variable effect generated by the relief formed in that side of the body. This will also provide a contrast with the optically variable effect generated by the relief formed in the surface of the binder/particles (first) reflective layer on the other side of the body, which will appear less bright due to the lesser degree of specular reflection. In a genuine device, this difference can be identified by a comparison of the two sides and act as a further authenticity check. The second reflection enhancing layer could be formed of a pattern of different materials, e.g. two or more different metals as described in EP-A-1294576.

Alternatively, the second reflection enhancing layer could comprise any of:

- an optical interference thin film structure;
- a layer containing metallic particles, optically variable particles or optically variable magnetic particles;
- a photonic crystal layer; or
- a liquid crystal layer.

Such materials can be used to provide the device with additional visual effects, e.g. exhibiting different colours at different viewing angles ("colour shift"), which will appear superimposed on the visual effect produced by the relief structure.

Preferably, the lateral extent of the reflection enhancing body defines a secure or decorative shape or pattern, preferably a fine line pattern, or an item of information, preferably a number, letter, alphanumerical text, a symbol or a graphic. Particularly where the whole reflective body shares the same lateral extent, this shape or pattern defines the bounds of the optically variable effects visible from both sides of the device, and hence contributes to the impression of two devices with extremely high registration. In advantageous embodiments, the reflection enhancing body includes at least two laterally offset regions which are visibly discontinuous. This increases the complexity of the device. In further preferred embodiments, the reflection enhancing body may comprise a screened working of discontinuous elements. Typically such elements would be too small to be individually discernible to the naked eye. Screened regions can be arranged to appear semi-transparent, at least in transmitted light.

The first and second reflection enhancing layers could be of substantially the same colour as one another, e.g. silver. However, in other preferred embodiments, the visible colour of the first reflection enhancing layer is different from that of the second reflection enhancing layer at least under illumination at selected wavelengths, such that the optically variable effect of the first relief structure exhibits a different colour from that of the optically variable effect of the second relief structure. This could be due to the inherent colours of the two materials being different (e.g. the first reflection enhancing layer may comprise aluminium particles and hence have a silver colour, whilst the second reflection enhancing layer may comprise copper and hence appear bronze). In other preferred cases, the first reflection enhancing layer may comprise an optically effective substance, visible under illumination at visible or non-visible wavelengths, preferably effective to impart a coloured tint to the first reflection enhancing layer. The optically effective substance(s) may or may not result in the two reflection enhancing layers having different colours.

It should be noted that the term "colour" used herein should be taken to encompass optical effects which are invisible under ambient illumination conditions (i.e. visible illumination wavelengths), and become apparent only under illumination at specific non-visible wavelengths such as UV or IR, as well as colours which are visible in visible light. In addition the term "colour" encompasses all hues and tones which are visible, including black, grey and silver as well as chromacities such as red, blue, green etc.

In particularly preferred embodiments, the optically effective substance(s) impart a coloured tint to the respective layer, which colour is visible under illumination at visible wavelengths. In this way the expected appearance of the device can be checked for without the need for any special illumination. In further preferred embodiments, the optically effective substance(s) are visible only under illumination at selected wavelengths outside the visible spectrum, preferably ultraviolet or infrared wavelengths. This provides for a more covert security feature which can be checked by eye or by machine.

In still further preferred embodiments, the optically effective substance(s) undergo a change in appearance in response to changes in one or more of temperature, pressure, strain or electrical potential. For example, thermochromic, piezochromic or electrochromic substances could be used. In each case the varying appearance of the substance may be visible within or outside the visible spectrum, and may change from one to the other.

Preferably, the optically effective substance(s) comprise dyes and/or pigments. Dyes are preferred in order to preserve the optical clarity of the layer.

As mentioned above, it is particularly preferred that the first optically variable effect generating relief structure is different from the second optically variable effect generating relief structure such that the first and second optically variable effects are different. For instance, each relief may give rise to different image content (e.g. two different holographic images) and/or could operate on a different optically variable relief generating principle (e.g. one hologram and one diffraction grating). However, this is not essential and the two relief structures could be identical if desired.

In a particularly advantageous example, the first optically variable effect generating relief structure is configured to exhibit an image of an object from a first viewpoint, and the second optically variable effect generating relief structure is configured to exhibit an image of the same object from a second viewpoint, preferably 180 degrees from the first viewpoint. For example, the first relief structure could replay as an image of a person's head viewed from the front, and the second relief could display the same from the rear. Alternatively, the "object" could comprise two or more letters, numbers or other symbols arranged to appear one in front of the other, with the apparent order being reversed in the image displayed by one relief compared to the other. The result is a device with strong visual impact which is particularly easy to recognise and describe.

Most preferably, the first and second optically variable effect generating relief structures are in register with one another. This gives rise to the two optically variable effects being registered to one another (i.e. have the same relative position in each of a series of identical devices). However, this is not essential.

Preferably, the optically variable effect generating relief structures each comprise one of: a hologram, a diffraction grating, a Kinegram™ or a non-holographic micro-optical structure such as a prismatic structure. Examples of prismatic structures suitable for the current invention include, but are not limited to, a series of parallel linear prisms with planar facets arranged to form a grooved surface, a ruled array of tetrahedra, an array of square pyramids, an array of corner-cube structures, and an array of hexagonal-faced corner-cubes. A second preferred type of micro-optical structure is one which functions as a microlens including those that refract light at a suitably curved surface of a homogenous material such as plano-convex lenslets, double convex lenslets, plano-concave lenslets, and double concave lenslets. Other suitable micro-optical structures include geometric shapes based on domes, hemispheres, hexagons, squares, cones, stepped structures, cubes, sawtooth structures, faceted structures or combinations thereof.

The transparent layer may take a number of forms depending in part on how the security device is to be incorporated or applied to an object of value. In some preferred examples, the transparent layer comprises a thermoplastic polymer—for instance forming part of a substrate web of e.g. polyester (PET), which may act as a support for the security device as a whole or even for a security document of which the security device will ultimately form part. In such cases, the first relief structure may be formed in the surface of the thermoplastic by conventional embossing techniques using heat and pressure, for example. In other preferred implementations, the transparent layer may comprise a curable polymer, preferably a UV-curable polymer. For instance, the first relief could be cast-cured into a coating of UV-curable resin.

As noted above, in some embodiments the transparent layer forms an integral part of a substrate, preferably a security document substrate or a security article substrate. For instance, the first relief structure may be embossed directly into a transparent layer making up the substrate of a polymer (or polymer/paper composite) banknote, or forming the substrate of a security article such as a security thread or foil which is later to be incorporated into or applied to a security document or other object of value. In other preferred embodiments, the transparent layer is disposed on a substrate, preferably a security document substrate or a security article substrate. This is the case for example where the first relief is formed in a coating or other layer carried by the substrate, e.g. a cast-cured relief.

If the device is to be formed independently of the security document or other object of value to which it is to be applied, the device preferably further comprises one or more transparent adhesive layers. These may form the outermost layer of the device on either or both sides. By selecting a transparent adhesive, the appearance of the optically variable effect is not diminished.

The invention further provides a security article comprising a security device as described above, the security article preferably comprising a transfer band or sheet, a security thread, a foil, a patch, a label or a strip. Also provided is a security document comprising a security device as described above or a security article as described above, the security document preferably comprising a banknote, cheque, identification document, certificate, share, visa, passport, driver's license, bank card, or ID card.

Further provided is a method of manufacturing a security device, comprising:

- forming a first optically variable effect generating relief structure in a surface of a transparent layer;
- applying a reflection enhancing body over the first relief structure such that a first side of the reflection enhancing body follows the contour of the first relief, the reflection enhancing body comprising at least a first reflection enhancing layer defining the first and/or second sides of the reflection enhancing body, the first reflection enhancing layer comprising a binder having reflective particles dispersed therein; and
- forming a second optically variable effect generating relief structure in the second side of the reflection enhancing body;
- such that when the device is viewed through the transparent layer, the optically variable effect of the first relief structure is visible and when the device is viewed from the other side, the optically variable effect of the second relief structure is visible.

By applying a reflection enhancing body over the first relief including at least a layer of binder containing reflective particles and then forming a second relief in the reflection enhancing body, a two-sided device in which the optical effect on each side is independent from that of the other can be created without the need for two metallisation steps. The first reflection enhancing layer acts to make one or both of the relief structures visible. It should be noted that the first and second relief structures are formed in two different relief-forming steps.

The reflection enhancing body can be applied having any of the properties or characteristics described above, and preferably is applied across less than the full area of the security device, i.e. such that the reflection enhancing body is absent across at least a portion of the device which may be transparent.

As mentioned above, the reflection enhancing body could consist solely of the first reflection enhancing layer. However, in a preferred embodiment, applying the reflection enhancing body comprises applying a second reflection enhancing layer over the first relief structure before or after applying the first reflection enhancing layer, such that the first reflection enhancing layer defines one of the first and second sides of the reflection enhancing body, and the second reflection enhancing layer defines the other of the first and second sides. Most preferably, applying the reflection enhancing body comprises applying the second reflection enhancing layer over the first relief structure before applying the first reflection enhancing layer, such that the first reflection enhancing layer defines the second side of the reflection enhancing body, and the second reflection enhancing layer defines the first side. The use of two reflection enhancing layers can be used to impart different reflection characteristics to each optically variable effect.

Advantageously, the second reflection enhancing layer comprises one or more metals or alloys thereof, preferably copper, aluminium, nickel or chrome, or any alloys thereof. As mentioned above, the use of a metal reflective layer gives rise to particularly bright replay of the optically variable effect. In particularly preferred embodiments, the second reflection enhancing layer is applied by vacuum deposition (encompassing sputtering, resistive boat evaporation or electron beam evaporation for example), or chemical vapour deposition. The second reflection enhancing layer could be formed as a pattern of two or more materials, e.g. two or more different metals, if desired, to impart an additional level of complexity to the device. EP-A-1294576 discloses spatial modulation of a reflection layer using two or more metals in this way.

Alternatively, the second reflection enhancing layer could comprise any of:

- an optical interference thin film structure;
- a layer containing metallic particles, optically variable particles or optically variable magnetic particles;
- a photonic crystal layer; or
- a liquid crystal layer.

The first reflection enhancing layer could be applied by any technique such as coating, deposition, transfer etc., but advantageously is applied by printing, preferably gravure printing, flexographic printing or slotted die printing. Printing techniques such as this enable a high degree of control over the shape or pattern in which the layer is laid down. Preferably, the first reflection enhancing layer is applied such that its lateral extent defines a secure or decorative shape or pattern, preferably a fine line pattern, or an item of information, preferably a number, letter, alphanumerical text, a symbol or a graphic. Advantageously, the first reflection enhancing layer is applied so as to include at least two laterally offset regions which are visibly discontinuous. The first reflection enhancing layer may be applied as a screened working of discontinuous elements.

In a most preferred embodiment, the method further comprises: after applying the first reflection enhancing layer, removing the material of the second reflection enhancing layer from regions of the device in which the second reflection enhancing layer is not covered by the first reflection enhancing layer, such that the lateral extent of the first and second reflection enhancing layers correspond. This demonstrates the extremely high degree of registration that is achievable and gives the impression of two (preferably different) security devices located in precise alignment.

Any technique for removing the material of the second reflection enhancing layer could be used which uses the first reflection enhancing layer as a mask to bound the regions to be removed. For example, the material could be removed by laser ablation or ion etching. However, most preferably the removal is performed by etching, the first reflection enhancing layer acting as an etch resist.

The first reflection enhancing layer may have any of the properties and characteristics identified above. In particularly preferred embodiments, the first reflection enhancing layer comprises a photoactive curing agent, preferably a UV curing agent, the method further comprising partially curing the first reflection enhancing layer before forming the second optically variable relief structure and/or fully curing the first reflection enhancing layer after forming the second optically variable relief structure. In this way, the first reflection enhancing layer can be laid down in a relatively fluid form, e.g. by printing, and then cured by irradiation or another stimulus (e.g. UV) to an intermediate stage at which the material is still formable. After the second relief has been embossed into the layer (or during embossing), the material may be cured further so as to ensure the relief structure is retained. Other hardening techniques could be used as appropriate, e.g. heat-activated curing.

As described above, the first and second reflection enhancing layers may have different optical characteristics, e.g. colours, and the first reflection enhancing layer may include an optically effective substance.

Preferably, the first and second optically variable effect generating relief structures are formed in register with one another, e.g. by embossing (or otherwise forming) each relief in an in-line manufacturing process. The first and second optically variable effect generating relief structures could each be formed either by embossing or cast-curing.

The first transparent layer may comprise a thermoplastic polymer, preferably having a curing agent, or a curable polymer, preferably a UV-curable polymer. The method may advantageously further comprise curing the first transparent layer before the second optically variable effect generating relief structure is formed. This may be subsequent to or during formation of the first relief, and before or after application of the reflection enhancing body.

Any of the other features of the security device described above may be incorporated through appropriate adaptation of the method.

Where the security device is formed as a security article, the security article including the device may be incorporated into or applied to a security document by any conventional technique, such as hot stamping, cold adhesion, laminating, incorporation into paper-making process, etc. The security device is preferably arranged to overlap at least partially and preferably fully with a window region of the document, e.g. an aperture or a transparent portion, which may be formed before or after incorporation of the security device.

Preferred embodiments of security devices and manufacturing methods in accordance with the present invention will now be discussed and contrasted with comparative examples, with reference to the accompanying Figures, in which:—

FIG. 1 schematically depicts a first comparative example of a security article incorporating a security device;

FIG. 2 depicts the security device of FIG. 1 applied to an exemplary security document, together with schematic views of (i) the appearance of the security device viewed by observer A; and (ii) the appearance of the security device viewed by observed B;

FIGS. 3*a* and 3*b* depict two further comparative examples of security articles incorporating security devices;

Figure 10:
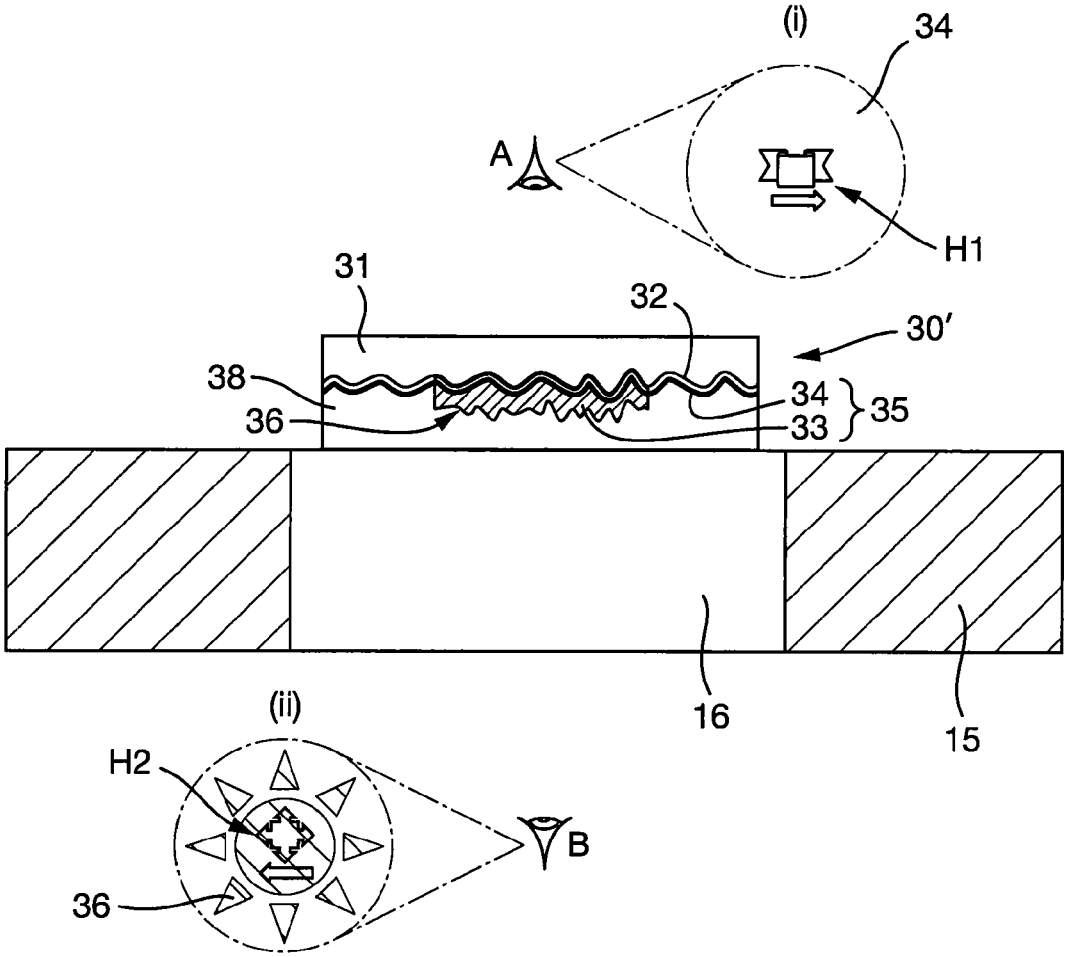
Figure 11:
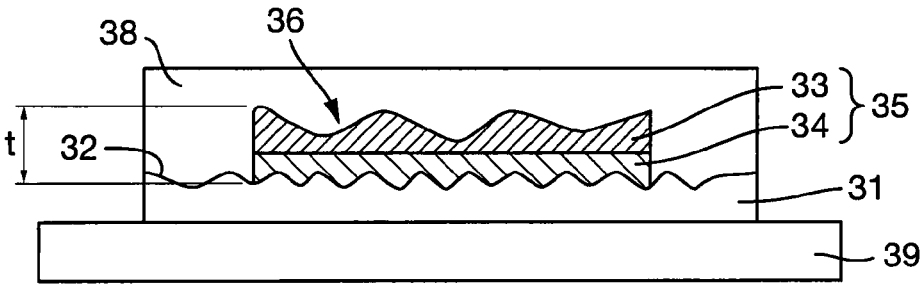
Figure 12:
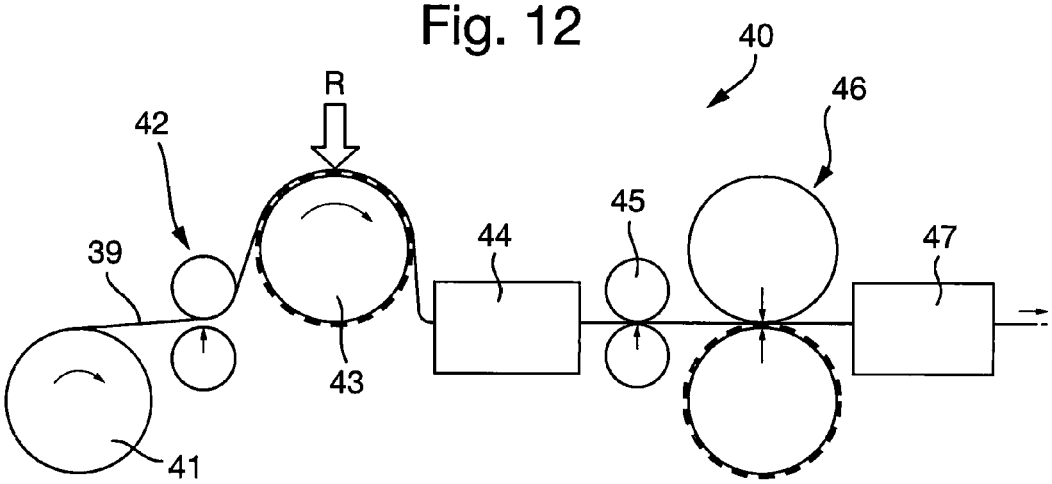
Figure 13:
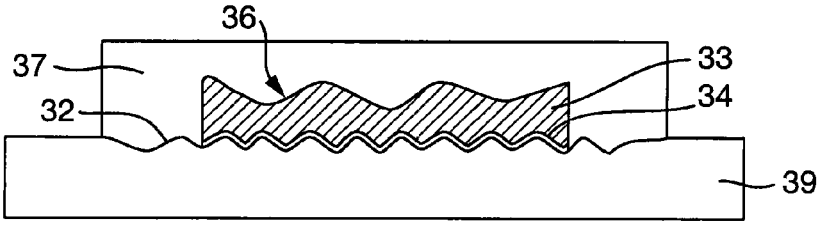
Figure 14A:
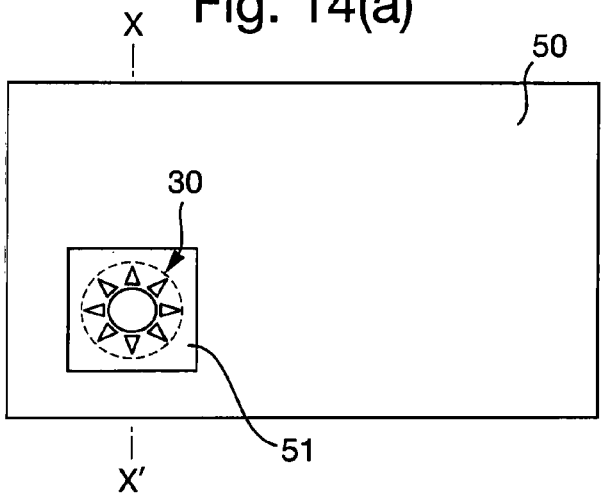
Figure 14B:
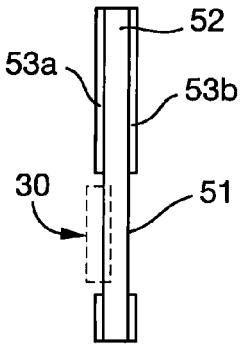

FIGS. 9 (*a*) to (*f*) depict a third embodiment of a security device in accordance with the present invention at various stages of manufacture;

FIG. 10 depicts a fourth embodiment of a security device in accordance with the present invention applied to an exemplary security document, together with schematic views of (i) the appearance of the security device viewed by observer A; and (ii) the appearance of the security device viewed by observer B;

FIG. 11 depicts a fifth embodiment of a security device in accordance with the present invention;

FIG. 12 shows exemplary apparatus suitable for carrying out a method of manufacturing in accordance with the present invention;

FIG. 13 depicts a sixth embodiment of a security device in accordance with the present invention;

FIGS. 14*a* and 14*b* depict an exemplary security document in accordance with the present invention, FIG. 14*b* showing a cross-section along the line XX' in FIG. 14*a;*

Figure 15A:
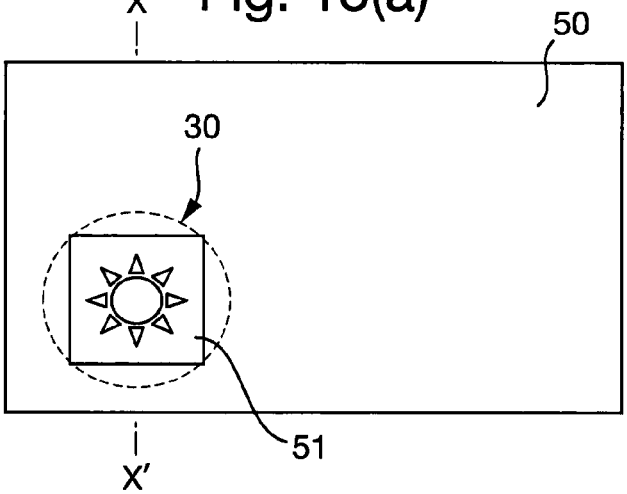
Figure 15B:
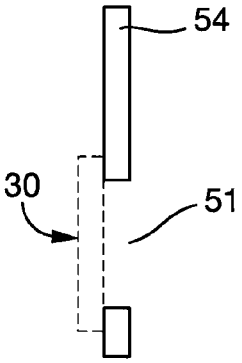

FIGS. 15*a* and 15*b* depict a further exemplary security document incorporating a security device in accordance with the present invention, FIG. 15*b* being a cross-section along line XX' in FIG. 15*a;*

Figure 16A:
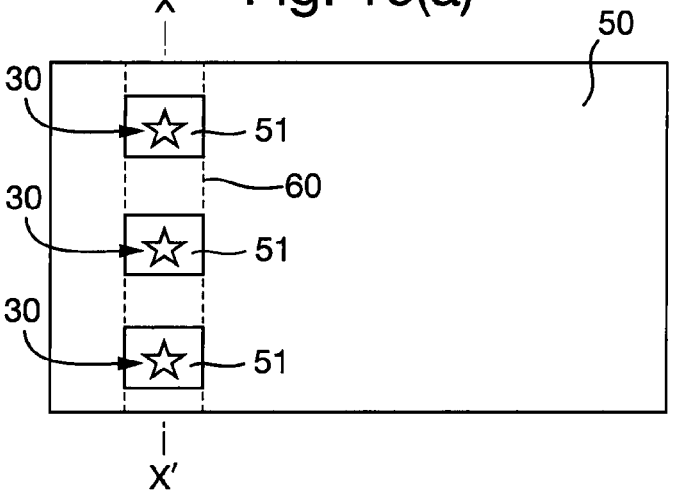
Figure 16B:
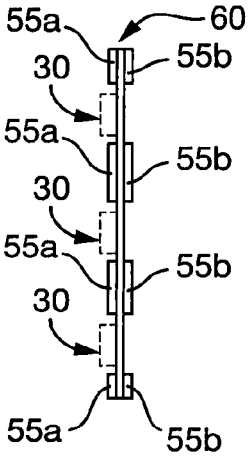
Figure 16C:
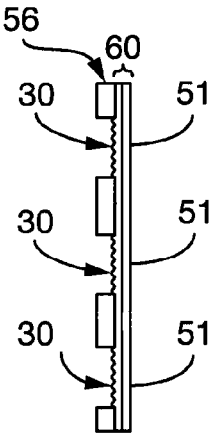
Figure 17A:
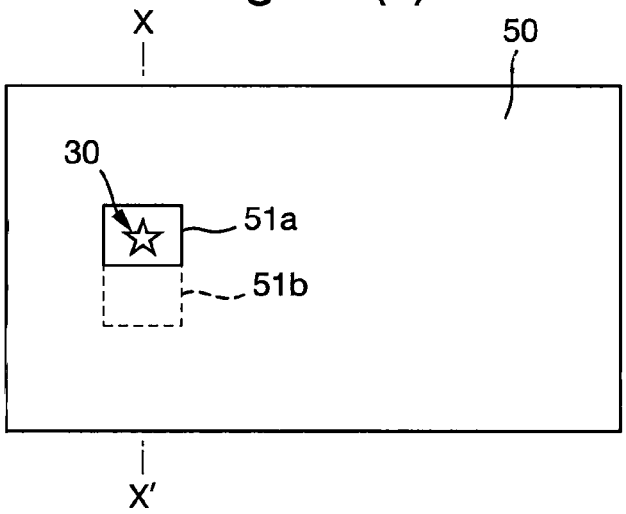
Figure 17C:
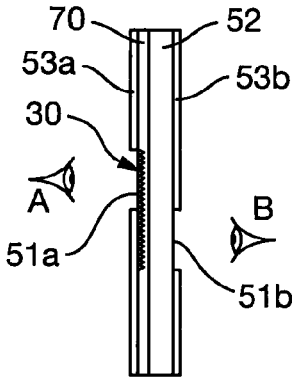
Figure 17B:
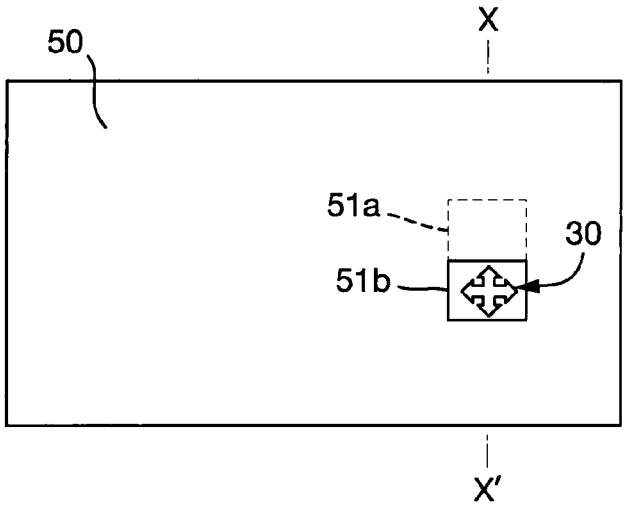
Figure 18A:
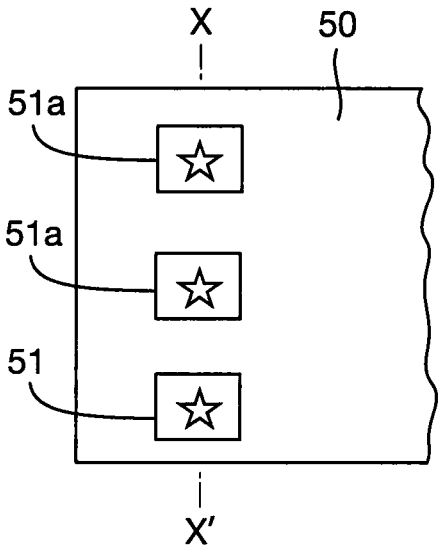
Figure 18B:
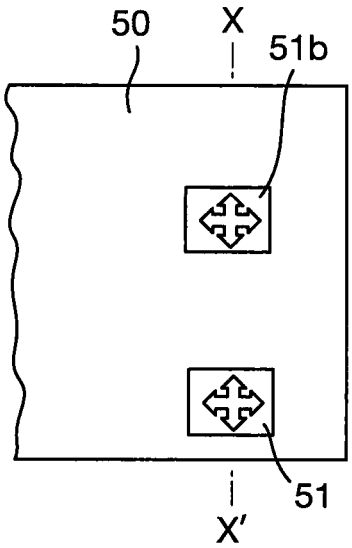
Figure 18C:
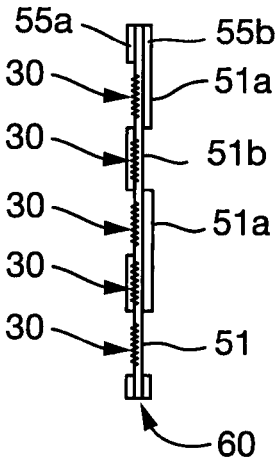

FIGS. 16*a*, 16*b* and 16*c* depict a further exemplary security document incorporating a security device in accordance with the present invention, FIGS. 16*b* and 16*c* depicting alternative cross-sections of the security document taken along line XX' in FIG. 16*a*; and FIGS. 17*a*, 17*b* and 17*c* depict another exemplary security document incorporating a security device in accordance with the present invention, FIGS. 17*a* and 17*b* showing front and reverse views of the document (flipped about its short edge), and FIG. 17*c* being a cross section along line XX' in FIGS. 17*a* and 17*b*; and FIGS. 18*a*, 18*b* and 18*c* depict a further exemplary security document incorporating a security device in accordance with the present invention, FIG. 18*a* showing a left portion of the document viewed from the front side, FIG. 18*b* showing a right portion of the document viewed from the rear side (the document having been flipped about its short edge), and FIG. 18*c* being a cross section along line XX' in FIGS. 18*a* and 18*b*.

The description below will focus on examples of security devices having optically variable effect generating relief structures in the form of holograms. By this we mean the relief is a structure which generates graphical images by the mechanism of diffraction of light. However, more generally the term "optically variable effect" means that an appearance is generated which varies depending on the viewing angle. Other examples of optically variable effects which might be implemented through the described relief structures include diffraction gratings, Kinegrams™ and prismatic effects, as mentioned above.

Figure 1:
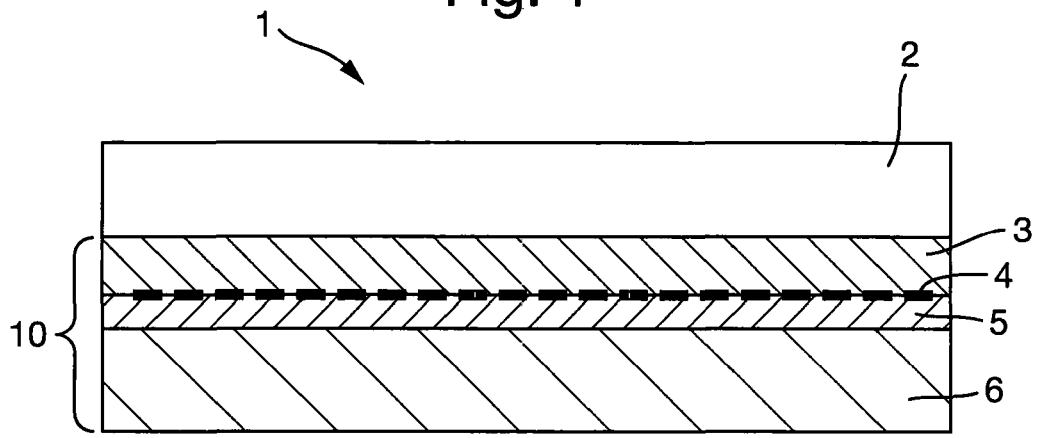

FIG. 1 shows a security article 1 according to a first comparative example. Here the security article 1 may comprise for example a transfer foil, security thread, patch or similar which includes a security device 10 carried on a support layer 2. Typically, the support layer 2 acts as a release sheet or strip from which the device 10 is detached upon application to a security document, in which case the support layer 2 can take any convenient form such as a (opaque, translucent or transparent) polymer or paper web. A release layer (not shown) may be provided between the support layer 2 and security device 10 to assist in the detachment of the security device 10 from the support layer 2 upon application of the device to a security document. For example, where the transfer is to take place by hot stamping, the relief layer may comprise a layer of wax or similar.

The security device 10 comprises a transparent layer 3 into which a holographic (or other optically variable) relief structure 4 is formed. It should be noted that the transparent layer 3 may in practice be formed of multiple layers laminated to one another, and this applies to all "layers" mentioned throughout this disclosure. The transparent layer 3 can be formed of any suitable transparent material in which a relief structure 4 can be formed, for example a conventional embossing lacquer such as a thermoplastic polymer or a radiation curable resin. The transparent layer 3 includes a colorant such as a suitable dye which imparts a tint to the layer 3. The tint may or may not be visible to the human eye under illumination at visible wavelengths. For example, the colorant could be invisible unless irradiated with selected wavelengths outside the visible spectrum, such as UV or IR, and could be phosphorescent, fluorescent or luminescent. However, in the most preferred examples, the colorant is visible under ambient lighting conditions in order that the colour effect is readily apparent without the need for specialist equipment.

The relief structure 4 (shown in FIGS. 1 to 4 schematically as a dashed line) is formed into the layer 3 using an appropriate conventional technique such as embossing under the combined action of heat and pressure, or cast curing, in which the layer 3 is coated as a relatively fluid resin onto the support layer 2 and a shaped die applied to the fluid resin having the desired relief shape. The resin flows to accommodate the die thereby taking on the desired relief shape and is simultaneously or subsequently hardened, e.g. by curing with radiation such as UV. Where the relief 4 is formed by cast curing, the layer 3 typically comprises a single homogenous film of resin. However, where the relief 4 is embossed, the layer 3 more typically comprises multiple layers including at least a protective coating layer (commonly termed a "scuff" layer) which will cover the hologram in use and an embossing layer which is usually of a material which is mechanically softer and/or of lower glass transition temperature than the protective layer. An intermediate layer may also be included. The colorant could be located in any of the multiple layers within layer 3, but most preferably is located in the protective coating and/or intermediate layer (if provided).

Following the formation of the relief structure 4, a reflection enhancing layer 5 such as a metal is applied, preferably by vacuum metallisation. The reflection enhancing layer 5 conforms to the relief structure 4, on both sides. As shown in the Figures, the metallisation covers the full area of the device.

Finally, in this example an optically clear adhesive 6 is applied over the reflection enhancing layer 5 to allow for easy adhesion of the device 10 to a document substrate. However, in other examples an adhesive layer 6 could be provided on the opposite side of the device (between layer 3 and support layer 2), on both sides of the device, or omitted entirely, e.g. if the security device is to be incorporated into a document during the paper-making process, or if adhesive is provided on the document's surface itself.

Figure 2:
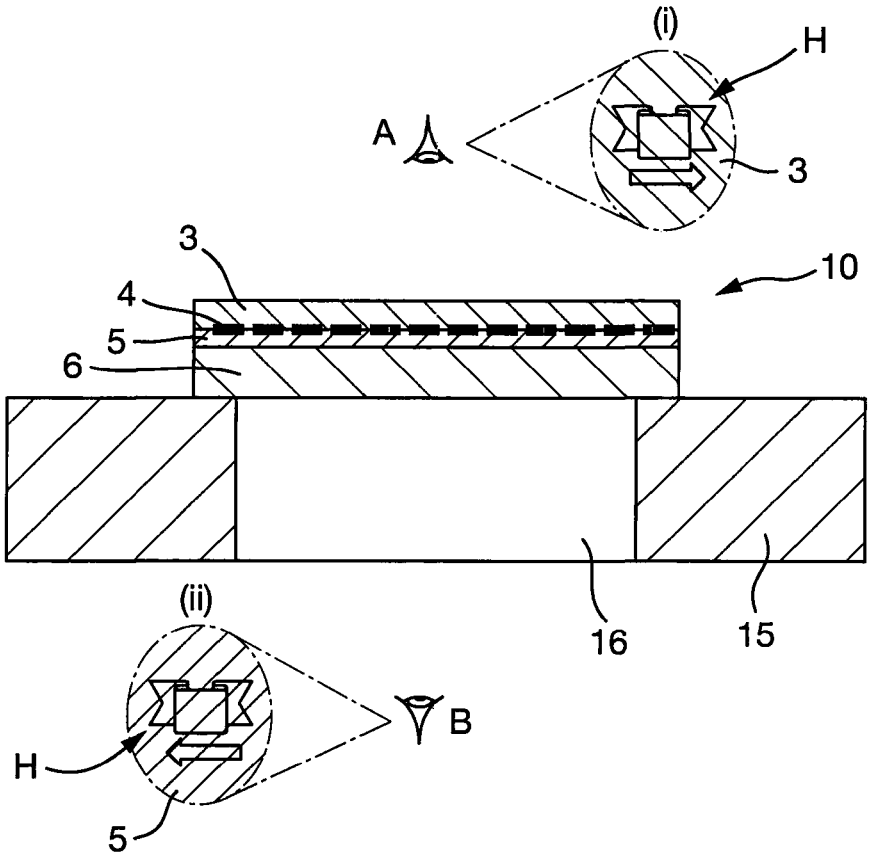

FIG. 2 shows the security device 10 now removed from security article 1 and applied to security document 15 in the region of window 16. Here, the security document is of conventional paper construction, having an aperture formed through the document substrate to define the window 16. The security device 10 is arranged to extend across the window 16 and onto the surrounding portions of the document substrate 15 to allow for adhesion between the document and the device. In other cases, the document could include a transparent material in at least one region forming a window 16, as will be described further in later embodiments.

The security device 10 is visible from both sides of the security document 15 as illustrated by observers A and B. From the location of observer A, the optically variable effect generated by relief structure 4 (e.g. a holographic image) in combination with reflection enhancing layer 5 is visible, as denoted in FIG. 2 (*i*) by the symbol labelled H. The optically variable effect is viewed through the coloured transparent layer 3 and hence the device as a whole including the optically variable effect appears tinted with the colour of layer 3. From the opposite side of the security document 15, observer B sees the same optically variable effect H, as shown in FIG. 2 (*ii*) although the content of the hologram will appear reversed (i.e. a mirror image of that seen from the position of observer A) due to the fact that the reverse side of relief 4 is being viewed. However, the colour of the optically variable effect and the device as a whole will appear different from that seen in position A since it will be determined solely by the colour of reflection enhancing layer 5 (assuming that the clear adhesive layer 6 is colourless). Thus, two different optically variable appearances can be observed from the two sides of the device. However, since each of the two optically variable appearances occupies the entire window area 16, the relationship between the two effects is not particularly distinct and the overall effect could be imitated through the provision of two different holographic devices of the appropriate colours on the two opposite sides of the document with little difficulty.

Figure 3A:
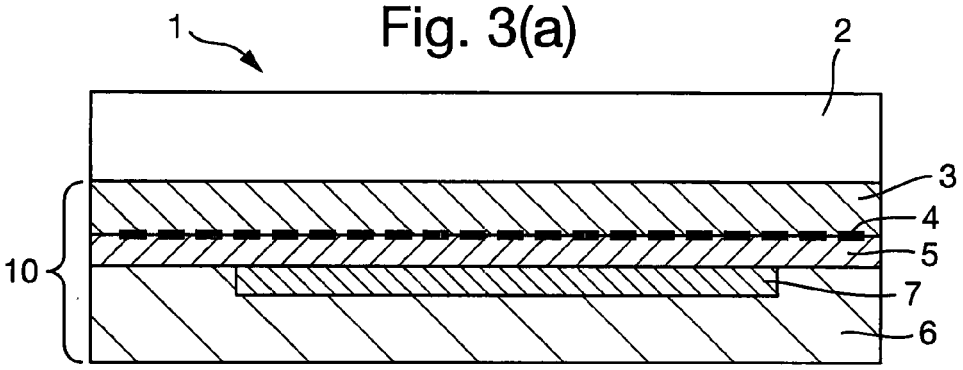
Figure 3B:
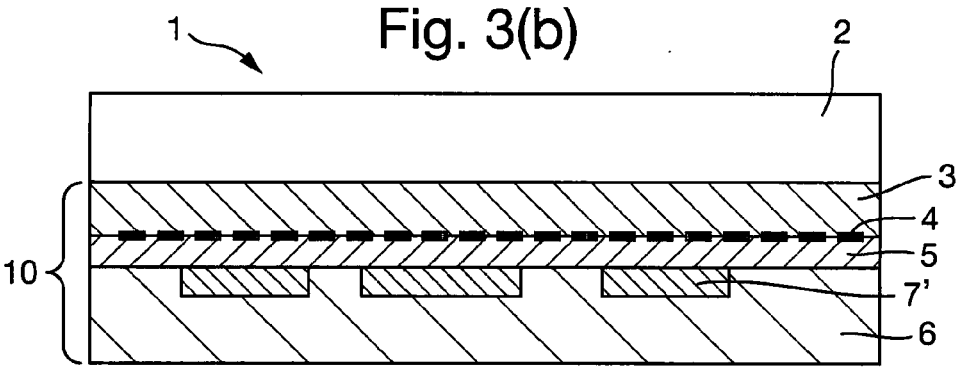

FIGS. 3*a* and 3*b* show further comparative examples in which two different optically variable appearances are achieved by providing a coloured print on one side of the reflection enhancing layer in a device. Generally, the reference numbers used in FIGS. 3*a* and 3*b* correspond to those used in FIG. 1 and their respective components can be formed in the same way as previously described. However, in this case, the transparent layer 3 into which relief structure 4 is formed need not include a colorant (although it may if desired).

After applying the reflection enhancing layer 5 (e.g. by vacuum metallisation), a coloured print 7 is applied by conventional printing techniques. The coloured print 7 may cover the full area of the device, or define a continuous shape as shown in FIG. 3*a*, or take the form of indicia such as letters, numbers, symbols or graphics, as shown in FIG. 3*b*.

Figure 4:
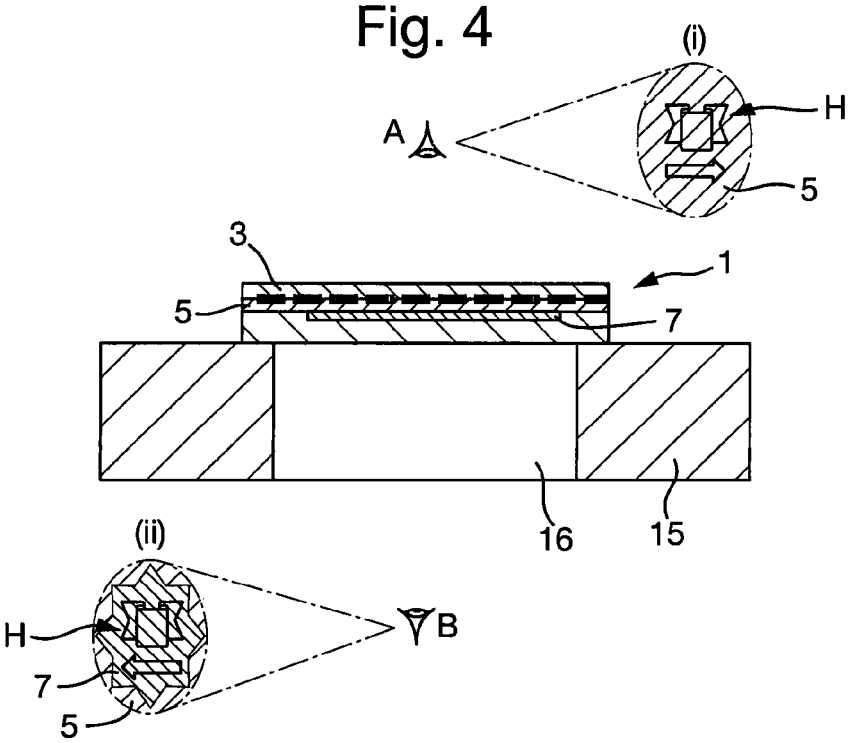
FIG. 4 shows the security device of FIG. 3*a* applied to an exemplary security document, together with schematic views of (i) the appearance of the security device viewed by observer A; and (ii) the appearance of the security device viewed by observer B.

FIG. 4 depicts the device of FIG. 3*a* applied to an exemplary security document 15 using any of the same techniques mentioned above. FIG. 4(*i*) depicts the appearance of the device from the position of observer A and here the hologram H is seen having the colour of the reflection enhancing layer 5 (e.g. silver). From the opposite side, observer B sees the same hologram H (reversed in direction) but now possessing the coloured tint of print layer 7, which in this case defines a star shape contained within the bounds of the (oval) device. Outside the star shape, the original colour of the reflection enhancing layer 5 will be visible and the optically variable effect will continue. This too is relatively straightforward for a determined counterfeiter to imitate, e.g. through the use of two holograms and appropriate overprinting.

Figure 5:
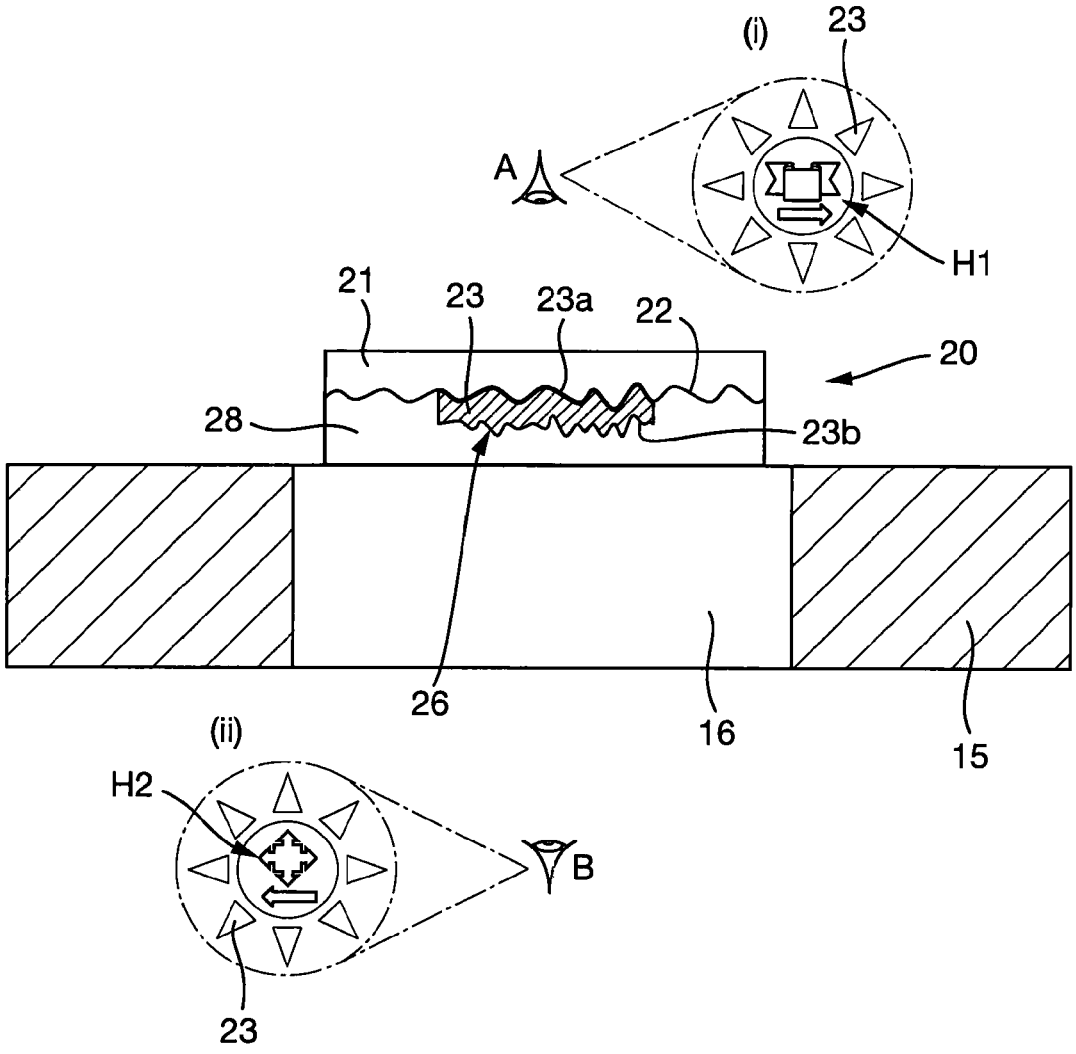
FIG. 5 depicts a first embodiment of a security device in accordance with the present invention applied to an exemplary security document, together with schematic views of (i) the appearance of the security device viewed by observer A; and (ii) the appearance of the security device viewed by observer B.

FIG. 5 depicts a security device 20 in accordance with a first embodiment of the invention, applied to an exemplary security document 15 in the region of a window 16. In this case, window 16 is constituted by a transparent portion of the document 15 with the security device 20 being applied directly thereto. However, the security device 20 could be applied across an aperture in the same way as previously described.

The security device 20 comprises a first transparent layer 21 carrying an optically variable effect generating relief structure 22 formed in its surface. A reflection enhancing body 23 conforms to the relief 22 on one of its sides 23*a*. The reflection enhancing body 23 comprises reflective material as will be described further below and therefore renders the optically variable effect generated by relief 22 visible in the region where the body 23 is present. The second side 23*b* of reflection enhancing body 23 carries a second optically variable effect generating relief structure 26 formed in the surface of the body 23. In this and other preferred embodiments, the second optically variable effect generating structure 26 is different from the first optically variable generating relief structure 22 such that the two optically variable effects which are generated are different, e.g. in their information content and/or in the mechanism on which they operate. However, in other cases the two relief structures 22 and 26 could be substantially identical, and give rise to optically variable effects which are the same. Nonetheless, as described below, the two relief structures 22 and 26 are formed independently of one another.

In this example, the reflection enhancing body 23 comprises a layer of material in which reflective particles, such as metal flakes, are dispersed. For example, layer 23 may comprise a transparent binder carrying a dispersion of aluminium flakes to give an overall impression of a substantially opaque, silver-coloured reflective material. The reflective nature of the layer 23 renders each of the optically variable effects generated by relief structures 22 and 26 visible from the two respective sides of the device, and thus no metallisation steps are necessary.

The reflective body 23 is present only across a region which is less than the whole area of the device 20, such that each of the optically variable effects generated by relief structures 22 and 26 will only be visible in the same sub-region of the device. Since the boundaries of the two optically variable effects will be defined by the same reflective layer 23, their lateral extent will automatically be exactly the same.

Surrounding the reflection enhancing body 23, a transparent adhesive 28 is provided which secures the device 20 to the document 15 in the region of window 16. Preferably, the transparent layer 21 and transparent adhesive 28 are colourless such that the optically variable effect region appears invisibly suspended within the device. However, either of these layers could carry a coloured tint if preferred.

FIG. 5 (*i*) illustrates the appearance of the device 20 from the position of observer A. From this viewpoint, a hologram image H1 is replayed, generated by relief structure 22. The holographic effect is visible only in regions where reflective layer 23 is present, which here forms the shape of a "sun" with a central circular region and multiple spaced triangular portions arranged to surround it. The remainder of the device (illustrated by the circular outline) is transparent, without any optically variable effect. FIG. 5 (*ii*) illustrates the appearance of the device from its opposite side, as seen by observer B. Here, the lateral extent of the optically variable effect is exactly the same as that seen by observer A, having the shape of a sun symbol with exactly the same size and position, since this also is defined by the extent of reflective layer 23. In the reflective regions, a second holographic image H2 is replayed, generated by the second relief structure 26. Outside the sun-shaped region, the device again appears transparent.

Thus, a single device achieves the appearance of two different holographic effect devices in exact register within one another. The result is a device with strong visual impact which cannot be readily imitated. For instance, it would be extremely difficult to achieve the necessary alignment through the use of two separate devices.

As noted above, the first and second relief structures 22 and 26 could be identical, but preferably are different giving rise to different optically variable effects. For example, one of the relief structures could define a hologram whilst the other may define a kinegram or pixelgram. In other examples, both of the relief structures may operate on the same principle as one another, but have different information content. For example, one relief structure may give rise to a first holographic image and the other may replay as a second, different holographic image. For instance, the first relief structure 22 may replay a holographic image of a currency symbol (e.g. "£"), whilst the second relief structure 26 may display an image representing a denomination (e.g. "10"). In particularly preferred examples, the two images generated by the relief structures, whichever mechanism(s) are utilised, are conceptually related to one another. For example, both images may be of the same object but from different viewpoints, most preferably separated by 180°. For instance, the first relief structure 22 may replay an image of a person's head viewed from the front and the second relief structure 26 may replay an image of the person's head viewed from the rear. Alternatively, the two images may be of an object such as a combination of symbols, with the first relief 22 displaying for example the number "5" positioned in front of a star symbol, and the second relief 26 showing an image of the star symbol in front of the "5" (and both symbols may be shown in reverse). By providing a strong visual relationship between the two images, the impact of the device is enhanced and the secure effect is more readily describable.

In this example, the reflective layer 23 takes the form of a sun-shaped symbol but any decorative or secure shape or pattern could advantageously be used, such as letters, numbers, symbols or other indicia, or a geometrical shape or fine line pattern. Preferably, the shape or pattern includes at least two visibly discontinuous regions—i.e. areas of the reflective body 23 which are sufficiently large and spaced by a sufficient distance that they can be individually distinguished by the naked eye, such as the central circular region and surrounding triangular areas making out the sun-shaped symbol in the present case. This increases the complexity and visual impact of the design. Within each such region (which appears continuous and unbroken, to the naked eye), the reflective body 23 could be applied in a contiguous, all-over layer, or could be applied as a screened working—that is, an array of spaced screen elements. The dimensions of a screen are typically sufficiently small such that the elements cannot be individually distinguished by the naked eye, and the region appears to the naked eye as if the layer is continuous. Nonetheless, this can be used to make the device semi-transparent, since light can be transmitted through the screen.

A first preferred method for manufacturing a security device such as that shown in FIG. 5 will now be discussed with reference to FIG. 6, which is a flow chart depicting selected steps of the method. In a first step S101, an optically variable effect generating relief structure 22 is formed on the surface a transparent layer 21. The transparent layer 21 could be carried on a substrate such as carrier layer 2 shown in FIG. 1, which may for example form the support layer of a security article, or the substrate could be an integral part of a security document such as a polymer banknote substrate or a layer of an identity card. This will be described further in later embodiments. The transparent layer 21 may comprise for example a thermoplastic layer such as polyester, polyethylene teraphthalate (PET), polyethylene, polyamide, poly(vinylchloride) (PVC), poly(vinylidenechloride) (PVdC), polymethylmethacrylate (PMMA), polyethylene naphthalate (PEN), polystyrene, or polysulphone; or an embossing lacquer layer, such as PMMA-based resins, acrylic resins or vinyl/styrene copolymers. In this case, the relief structure 22 may be formed through a conventional embossing process, e.g. involving forming a surface relief by impressing a cylindrical image forming die (e.g. an embossing roller) into the thermoplastic layer 21 through the combined action of heat and pressure. Alternatively, the transparent layer 21 could be a cast cure resin. For example, the layer 21 may be applied as a viscous liquid coating or film of monomer which is contacted by an image forming die or roller. The surface relief is cast into the film by the simultaneous or near simultaneous exposure of the layer 21 to radiation (e.g. UV radiation), causing polymerisation. The surface relief 22 is thus set into the layer 21. UV curable polymers employing free radical or cationic UV polymerisation are suitable for the UV casting process. Examples of free radical systems include photo-crosslinkable acrylate-methacrylate or aromatic vinyl oligomeric resins. Examples of cationic systems include cycloaliphatic epoxides. Hybrid polymer systems can also be employed combining both free radical and cationic UV polymerization.

Whichever technique is adopted, it is important that the integrity of the surface relief structure 22 is not compromised or affected by subsequent processing required to form the second relief structure 26. The first transparent layer 21 should therefore comprise a material which both has a high softening temperature (or high glass transition temperature) and is mechanically hard. For instance, the first relief structure should preferably be able to withstand applied pressure at temperatures of around 130 to 150 degrees C. Where relief structure 22 is to be formed in a thermoplastic layer 21, it is preferable that the layer 21 has a suitable UV cross-linking system added such that once the relief 22 has been embossed into its surface, the layer can be exposed to UV (or other appropriate radiation) and thus cross-linked, thereby increasing its softening temperature and hardness following the embossing. Of course, other types of curing or hardening agents could be used analogously. Cast curing methods of forming the relief 22, on the other hand, are generally inherently suitable since once cured the resin in which the relief is formed will be robust. If the first transparent layer is cross-linked (either through the use of a cross-linking agent added to a thermoplastic, or through the use of a cast-cure resin), its softening temperature effectively becomes infinite.

In step S102, the reflection enhancing body 23 is formed by applying a layer containing reflective particles to the relief 22. The reflective layer is formable in that, after application, it will accept the impression of a further relief structure and retain it. For example, the reflective layer could comprise a clear thermoplastic resin which acts as a binder for a dispersion of metallic flakes (e.g. a thermoplastic metallic ink). Alternatively the reflective particles could be optically variable particles comprising e.g. metal/dielectric stacks or dielectric/dielectric stacks, or optically variable magnetic particles which are of similar construction but additionally incorporate magnetic material. It is desirable that the softening temperature of the thermoplastic binder is significantly less than that of the transparent layer 21 supporting the first relief structure 22.

In more detail, the reflective particles may be metallic particles derived from metals such as aluminium, copper, zinc, Nickel, chrome, gold, silver, platinum, or any other metals or associated alloys such as copper-aluminium, copper-zinc or nickel-chrome which may be deposited under vacuum. Organic colorants or dyes may be added to the binder to achieve the desired colour.

It is preferable, though not essential, that the reflective particles be highly platelet or lamella in nature—that is the dimensions of the reflective particles along the axis parallel to the reflective interface (the platelet length) is significantly greater than the dimensions transverse to the reflective interface (the platelet thickness). By "significantly greater" we mean the platelet length should be at least 2 to 5 times the thickness and desirably more. Platelet thickness depending on the basic method of production may range 10 nm to 100 nm, but for application to holographic or diffractive structures the preferred thickness is in the range 10 nm to 100 nm and more especially 20-50 nm. It is desirable to ensure that the flake conforms to the shape of the optical microstructure relief with a good spatial fill factor and this can be achieved by choosing that platelet length and width, are such that both dimensions exceed the periodicities present in the optically variable diffractive micro-structure. Also the fact that the flakes lengths and widths are on average 40 times their thickness means that they are not mechanically stiff enough to be self-supporting under the influences of gravity and the compressive forces experienced by the dispersion as it dries or cures. Thus they will tend to conform readily to the shape of the grating reliefs as the inks dries. This improved conformance to the shape of the grating profiles together with the fact that typically each individual flake will without interruption tend to span one grating groove will provide much higher diffraction efficiency than for 100 nm flakes. Further improvement in diffraction efficiency will be delivered by further increases in platelet length and width. Specifically if we regard each diffraction groove as a single secondary source of disturbance within a chain or series of coherent secondary sources (that is the grating array) then it is known from basic diffraction theory that full diffraction efficiency is not achieved until there is an uninterrupted array of 8-10 or more coherent secondary sources i.e. reflective grating grooves. Thus in an exemplary scenario the platelet flakes would have a length or width sufficient to span at least 8-10 grating grooves. Thus for a typical diffractive optically variable image device, especially preferred platelet lengths and widths will be of the order 10,000 nm or more.

The first reflection enhancing layer may be curable by UV radiation in the same manner as the curable transparent material mentioned above or the reflection enhancing layer may be physically drying and may be water or solvent based. For a physically drying material the binder may comprise any one or more selected from the group comprising nitrocellulose, ethyl cellulose, cellulose acetate, cellulose acetate propionate (CAP), cellulose acetate butyrate (CAB), alcohol soluble propionate (ASP), vinyl chloride, vinyl acetate copolymers, vinyl acetate, vinyl, acrylic, polyurethane, polyamide, rosin ester, hydrocarbon, aldehyde, ketone, urethane, polythyleneterephthalate, terpene phenol, polyolefin, silicone, cellulose, polyamide and rosin ester resins.

The composition may additionally comprise a solvent. The solvent used in the metallic ink may comprise any one or more of an ester, such as n-propyl acetate, iso-propyl acetate, ethyl acetate, butyl acetate; an alcohol such as ethyl alcohol, industrial methylated spirits, isopropyl alcohol or normal propyl alcohol; a ketone, such as methyl ethyl ketone or acetone; an aromatic hydrocarbon, such as toluene; or water.

For a UV curable material the binder may comprise an acrylic based UV curable clear embossable lacquer or coating. Such UV curable lacquers can be obtained from various manufacturers, including Kingfisher Ink Limited, product ultraviolet type UVF-203 or similar. Other suitable materials for the binder include UV curable polymers employing free radical or cationic UV polymerisation. Examples of free radical systems include photo-crosslinkable acrylate-methacrylate or aromatic vinyl oligomeric resins. Examples of cationic systems include cycloaliphatic epoxides. Hybrid polymer systems can also be employed combining both free radical and cationic UV polymerization.

The reflective layer 23 is applied over the relief 22 across a defined region which is less than the full area of the device (e.g. less than the full lateral extent of the transparent layer 21). The reflective layer 23 is preferably laid down in the form of a decorative or secure shape or pattern such as letters, numbers, symbols or other indicia or a shape or fine line pattern. For instance, the reflective layer 23 may be laid down in the shape of a "sun" symbol as previously discussed. In order to achieve a high degree of control over the arrangement of the reflective layer 23, the material is preferably laid down using a printing technique, such as gravure printing. However, other application techniques such as coating, deposition or transfer methods could be used as appropriate.

The reflective layer could be made up of two or more different materials containing reflective particles, e.g. having different colours. For instance, in one region (e.g. the central circular region of the "sun" shaped symbol), the reflective layer 23 may comprise a material containing aluminium particles, whilst in another region (e.g. the surrounding triangular regions) the layer 23 may comprise a material containing copper particles. Alternatively or in addition, the binder in which the particles are dispersed may be different in different regions, e.g. containing different optically effective substances such as colourants. The different materials may be arranged to display a pattern within layer 23. Embodiments such as these can be implemented by laying down a first material (e.g. by printing) followed by a second material in register.

Optionally, the reflective material(s) used to form layer 23 may include a curing or hardening agent, such as a UV curing agent, in which case once the layer has been applied it may be exposed to appropriate radiation or another stimulus (e.g. heat) in order to achieve partial (incomplete) curing of the material. That is, the viscosity of the material would be increased, but the material would remain formable. This assists in fixing the position of the reflective layer and protecting the first relief structure 22 whilst allowing for the later formation of the second relief structure 26. However, the reflective nature of layer 23 may make radiation-curing techniques inherently inefficient and so alternative curing agents such as heat-activated agents may be preferred.

In step S103, the second relief structure 26 is formed in the second side of the reflection enhancing body 23, e.g. using a conventional embossing process under heat and pressure. As discussed above, it is preferred but not essential that the second relief structure 26 is different from the first relief structure 22. The second relief structure 26 may or may not be formed in register with the first relief structure 22, depending on design requirements.

If the reflective material 23 includes a curing or hardening agent, after or during the formation of the second relief structure 26, the layer 23 may be fully cured or hardened, e.g. by radiation with UV, to fix the second relief structure.

Figure 6:
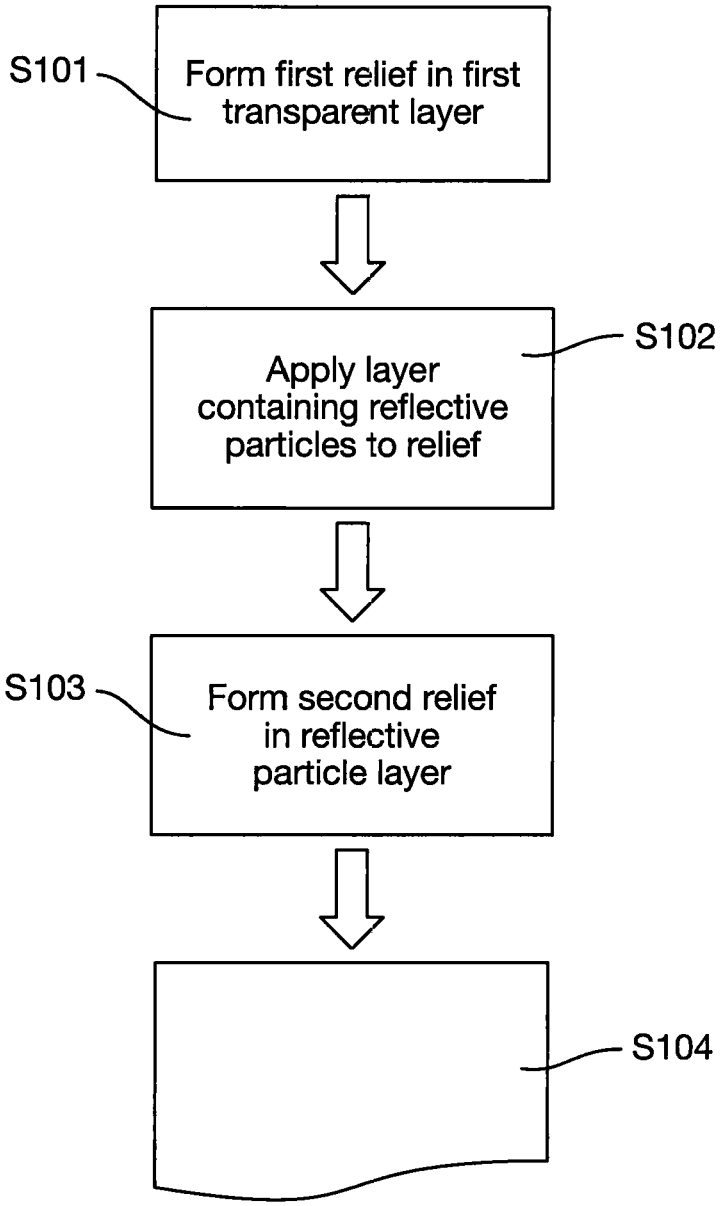
FIG. 6 is a flow diagram demonstrating selected steps in a first exemplary method of manufacturing a security device in accordance with the present invention.

Subsequent processing steps represented by box S104 in FIG. 6 are optional and will depend on how the device is to be applied to or incorporated into a document of value or other object. In a preferred example, as illustrated in FIG. 5, an optically transparent adhesive 28 is applied over the device for subsequent adhesion to the surface of a document or other object to be protected. Suitable transparent adhesives may contain components such as urethanes, methacrylates and carboxy-functional terpolymeres (such as UCAR™ VMCH and VMCA). WO-A-2008/135174 also discloses transparent adhesives. In other examples, the adhesive 28 may be omitted entirely or could be provided on the opposite side of the device adjacent first transparent layer 21, or on both sides of the device.

Figure 7:
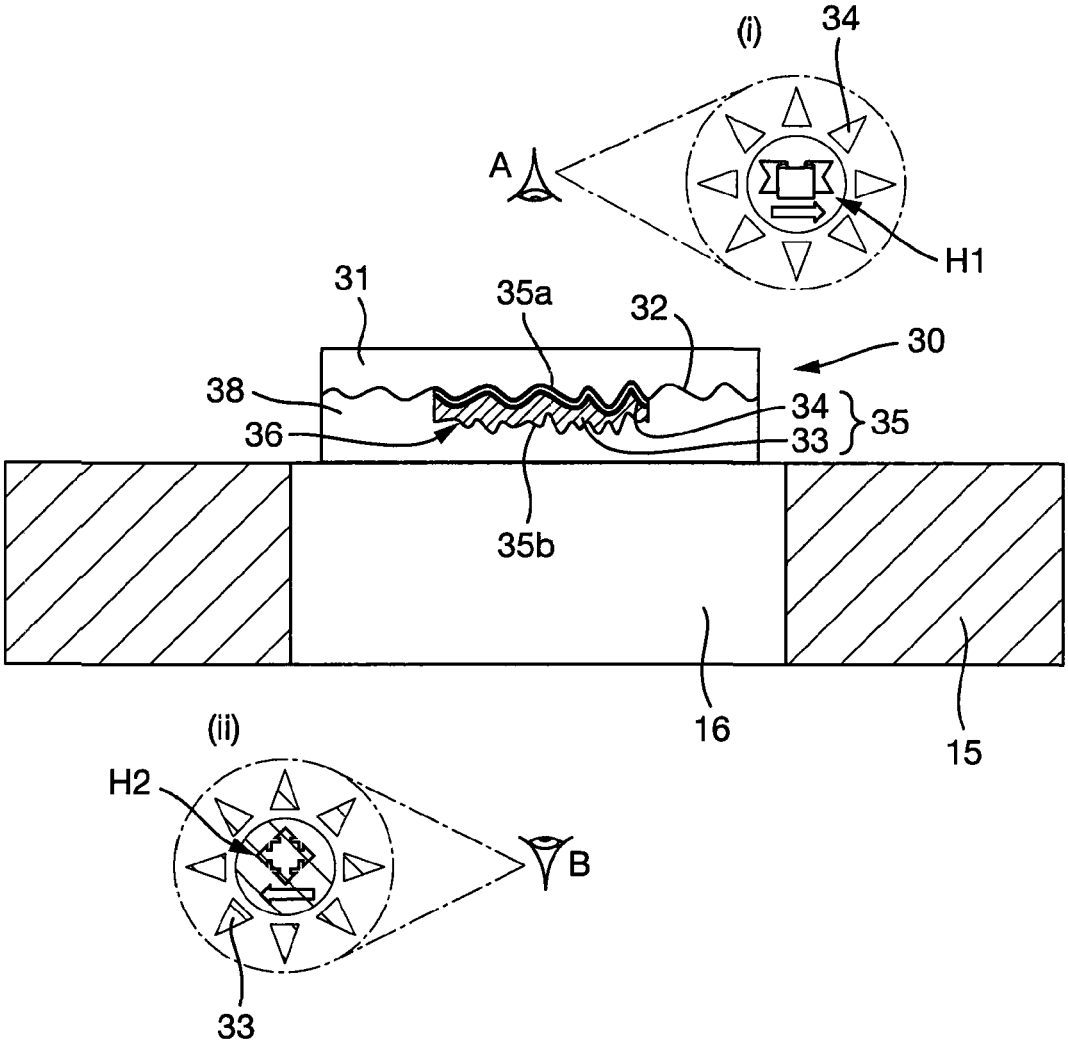
FIG. 7 depicts a second embodiment of a security device in accordance with the present invention applied to an exemplary security document, together with schematic views of (i) the appearance of the security device viewed by observer A; and (ii) the appearance of the security device viewed by observer B.

FIG. 7 depicts a second embodiment of a security device 30 in accordance with the present invention, which has been applied to a security document 15 in the same manner as described above in relation to FIG. 5. Many components of the device 30 correspond to those discussed above in relation to FIG. 5 and therefore be detailed again here only briefly.

A first relief structure 32 is formed in a transparent layer 31 in the same way as discussed above. Again, a reflection enhancing body 35 is provided in a region of the device which covers less than its whole area. In this example, as before, the reflection enhancing region 35 takes the form of a sun-shaped symbol. As before, a first side 35*a* of the reflection enhancing body conforms to the first relief structure 32 and renders it visible. A second optically variable effect generating relief structure 36 is formed in the second side 35*b* of the reflection enhancing body, giving rise to a second optically variable effect.

In this case however the reflection enhancing body 35 is formed of two reflection enhancing layers. First reflection enhancing layer 33 is a layer containing reflective particles as in the case of layer 23 described above. Second reflection enhancing layer 34 in this example is a metal layer (i.e. a layer consisting solely of metal(s)), e.g. aluminium or copper. In this embodiment, the second reflection enhancing layer 34 forms the first surface 35*a* of reflection enhancing body 35 and thus conforms to the first relief structure 32 rendering it visible. The first reflection enhancing layer 33, comprising reflective particles, contacts the metal layer 34 on one side and its other surface carries the second relief structure 36, rendering its optically variable effect visible by virtue of its reflective nature. As in this example, the two reflection enhancing layers 33 and 34 preferably have different compositions, with the second reflection enhancing layer 34 preferably not comprising a dispersion of reflective particles but rather taking the form of a reflective layer which follows to the relief structure, such as a metal layer in the example given. In this way, each of the optically variable effect generating relief structures will have different reflection characteristics. For example, in the present embodiment the metal layer 34 will give rise to a brighter holographic replay from relief structure 32 than that from relief structure 36 achieved by reflective particle layer 33. This difference in appearance may be relatively subtle but can be used as an additional authenticity check by an experienced handler. The first and second reflective layers preferably have the same lateral extent as one another such that an optically variable effect generated by relief structures 32 and 36 will only be rendered visible in exactly the same regions of the device. Thus, in this example, both reflective layers 33 and 34 define exactly the same sun-shaped symbol, with the same dimensions and position.

In alternative examples, the second reflection enhancing layer 34 could comprise an optical interference thin film structure; a layer containing metallic particles, optically variable particles or optically variable magnetic particles; a photonic crystal layer; or a liquid crystal layer. Such materials can be used to provide the device with additional visual effects, e.g. exhibiting different colours at different viewing angles ("colour shift"), which will appear superimposed on the visual effect produced by the relief structure.

FIG. 7 (*i*) illustrates the appearance of the device 30 from the position of observer A. A first holographic image H1 is displayed by the first surface relief 32 in the region of reflective body 35, having the same sun symbol shape as described previously. Since the first relief structure 32 is rendered visible by metal layer 34, the holographic replay appears bright and has the background colour of the metal layer 34 (e.g. silver). Outside the sun-shaped region, the device appears transparent.

The appearance of device 30 from the position of observer B is depicted in FIG. 7 (*ii*), and here the optically variable region has exactly the same lateral extent as that seen from the position of observer A, namely defining a sun-shaped symbol. Within that region, a second holographic image H2 is displayed. Since the second relief structure 36 defining holographic image H2 is rendered visible by the reflective particle layer 33, its replay is less bright than that of holographic image H1 seen by observer A, as indicated by the shading in FIG. 7 (*ii*). However, the difference is likely to be subtle.

It will be appreciated that, if desired, the order of layers 33 and 34 could be swapped, with reflective particle layer 33 conforming to first relief structure 32 and rendering it visible for observer A, and metal layer 34 forming the other side of reflective body 35 into which the second relief structure 36 is formed.

The colour of the two reflection enhancing layers 33 and 34 could be substantially the same, e.g. silver where for example layer 33 comprises aluminium particles and layer 34 is an aluminium layer. This gives rise to the impression that a single device is present yet one which appears different from different sides of the device. Alternatively, the colours of the two reflection enhancing layers 33 and 34 may be different, e.g. layer 33 comprising aluminium particles, appearing silver, and layer 34 comprising a layer of copper and therefore appearing bronze. If desired, an optically effective substance could be incorporated into reflective particle layer 33 such as a colorant typically in the form of a dye or pigment. Various different types of colorant may be used which may or may not be visible to the human eye under normal illumination conditions. For example, the colorant could be visible or detectable only under selected non-visible radiation wavelengths such as ultra violet or infrared. However, in the most preferred embodiments, the colorant is visible under ambient white light and imparts a coloured tint to the layer 33. Thus for example from the position of observer A, the sun-shaped region may appear silver, e.g. due to the use of an aluminium layer 34, whilst from the position of observer B, the sun-shaped region may appear metallic red, yellow or blue etc, due to coloured reflective particle layer 33.

Figure 8:
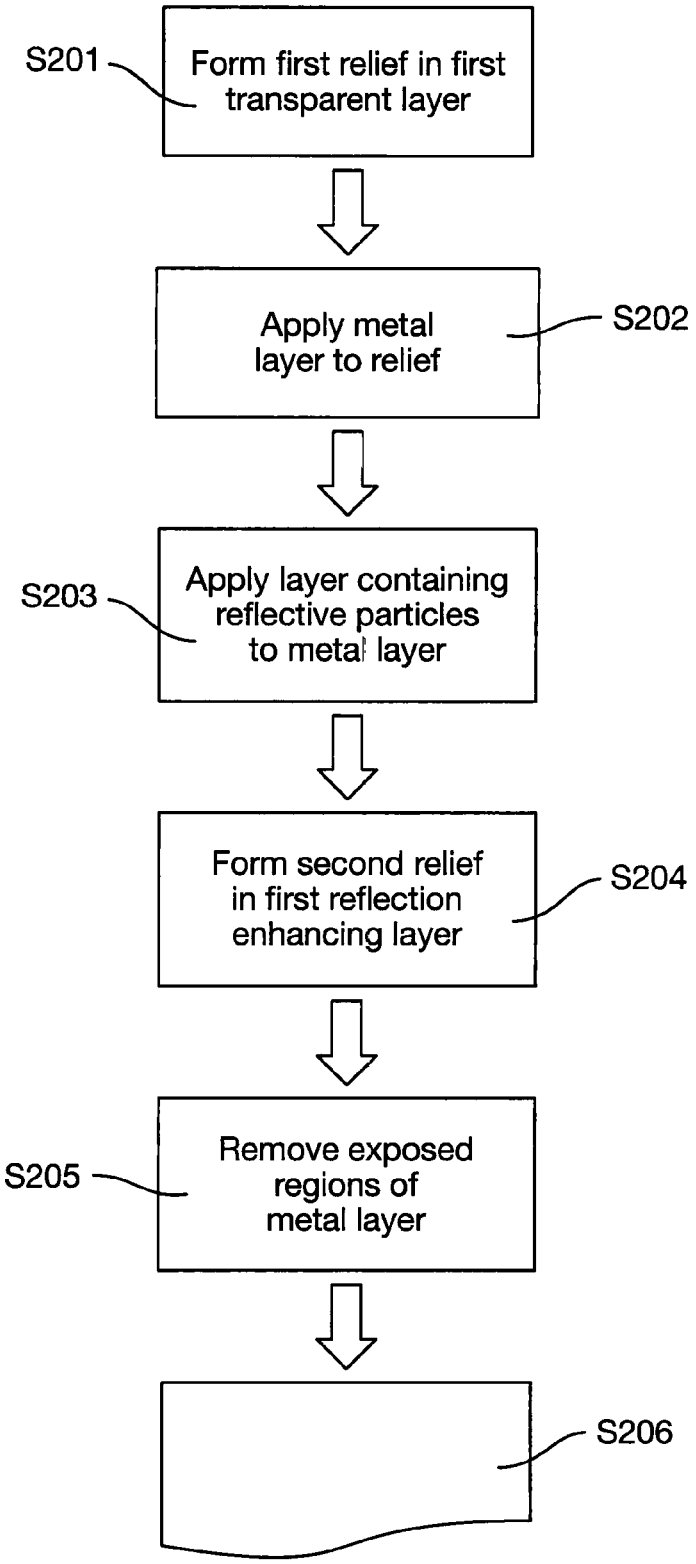
FIG. 8 is a flow diagram demonstrating selected steps in a second exemplary method of manufacturing a security device in accordance with the present invention.
Figure 9A:
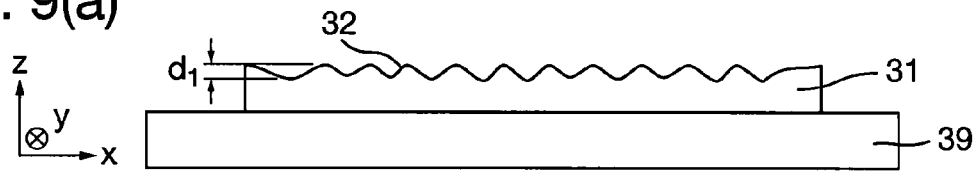
Figure 9B:
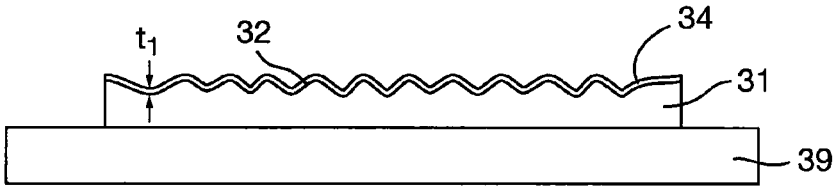
Figure 9C:
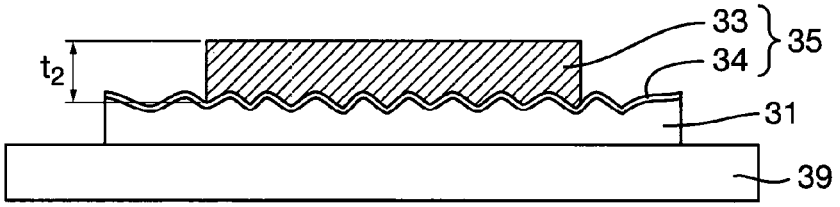
Figure 9D:
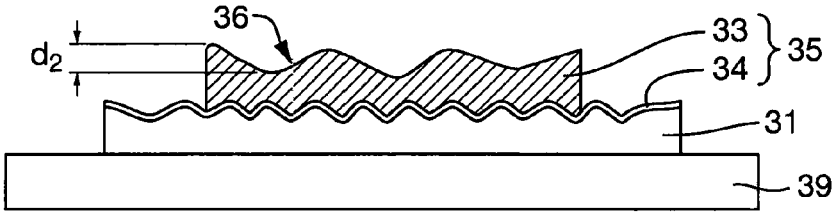
Figure 9E:
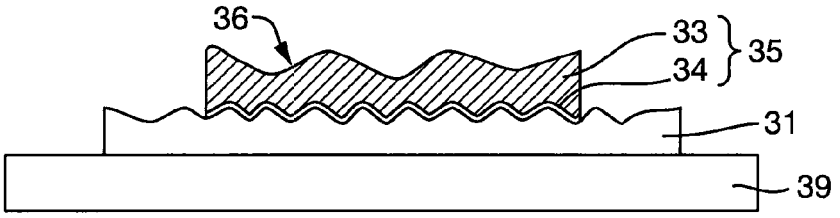
Figure 9F:
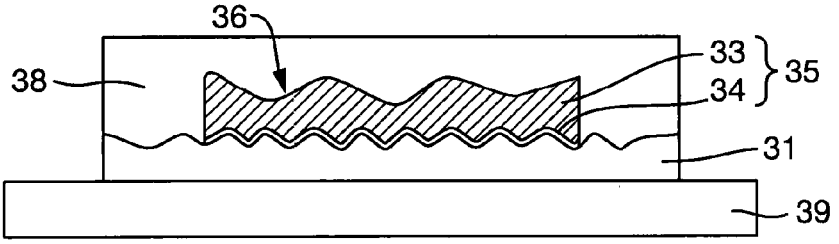

FIG. 8 depicts selected steps of a preferred method for manufacturing a security device such as that shown in FIG. 7. For cross reference with FIG. 8, FIGS. 9 (*a*) to (*f*) show a security device in accordance with a third embodiment of the present invention, made according to the described method, at various stages of production.

In the first step S201, a first optically variable effect generating relief structure 32 is formed in the surface of a transparent layer 31 which in this example is carried on substrate 39. Substrate 39 could be for example a support layer of the security article or an integral part of a security document as discussed in relation to the first embodiment. Likewise, transparent layer 31 and relief structure 32 can be formed using any of the techniques previously described.

In step S202, as depicted in FIG. 9 (*b*), a metal (or other reflective) layer 34 is applied to the relief 32 and conforms to its surface. In some cases the thickness $t_2$ of the metal layer 34 may be kept very thin in order to render it semi-transparent, e.g. if it is desired to perceive the colour of subsequent layers through the metal layer 34. The metal layer is typically formed with one or more metals and/or alloys and if desired two or more metals could be laid down in a pattern of different regions to collectively form the layer 34, as described in EP-A-1294576. The metal layer could be laid down using any appropriate technique, but vacuum deposition is preferred. It should be noted that whilst typically the metal layer 34 will be applied directly to the transparent layer 21 and will therefore be in contact with the surface of the element in which the relief structure 32 is formed, the metal layer 34 could be spaced from that element by an intermediate transparent layer or the like, provided that the intermediate layer is sufficiently thin so that the metal layer again follows the surface relief contour.

Step S203 is the same as step S102 described above and comprises applying layer 33 containing reflective particles to the surface relief 32 over the metal layer 34, as shown in FIG. 9(*d*). Again, the reflective particle layer 33 is applied across a defined region which is less than the full area of the device (e.g. less than the full lateral extent of the first transparent area), forming for instance the sun-shaped symbol described above. The layer 33 is preferably laid down to include discontinuous regions and may take the form of a screened working. Preferably, the material is laid down using a printing technique such as gravure printing. More than one different reflective particle material could be used to form the layer with an integral pattern as previously described.

As before, the layer 33 preferably comprises reflective particles dispersed within a clear formable material such as a thermoplastic. Suitable examples include vinyl resins such as UCAR™ VMCA Solution Vinyl Resin or UCAR™ VCMH Solution Vinyl Resin, both of which are supplied by The Dow Chemical Company and are carboxy-functional terpolymers comprised of vinyl chloride, vinyl acetate and maleic acid. Most preferably, the material forming layer 33 is suitable for acting as an etch resist, with the layer 33 protecting the metal layer 34 during a subsequent etching step in which uncovered regions of metal layer 34 are removed, as will be discussed below. Typically this removal step will be achieved by immersing the structure in an etchant solution which dissolves or otherwise removes the uncovered metal. For example, where the metal layer is aluminium, sodium hydroxide can be used as the etchant.

Where the reflective layer is copper, an acidic etchant is typically used, such as (i) a mixture of Hydrochloric acid 50% v and Ferric chloride (40 Baume) 50% v, at room temperature; or (ii) a mixture of Sulphuric acid (66 Baume) 5-10% v and Ferrous sulphate 100 g/liter, at 40 to 60 degrees C. Other etchants may also be used such as nitric acid but generally the above systems are the most convenient to work with. The exemplary materials mentioned above for forming the second layer 33 (UCAR™ VMCA and UCAR™ VMCH) are suitable etch resists for both of these etch systems.

In all embodiments, the thickness $t_2$ of the reflective particle layer 33 (or, more generally, the reflection enhancing body, where this comprises more than one layer which each contribute significantly to its thickness) in the direction of the device normal (z-axis) should be sufficient such that the relief structure 32 is not automatically replicated in the layers of the opposite surface. Thus for example the layer 33 should have a thickness $t_2$ greater than the maximum profile depth $d_1$ of the relief structure 32, preferably significantly greater, such that the layer 33 essentially fills in and smoothes over the relief. The thickness $t_2$ should also be greater than the maximum profile depth $d_2$ of the second relief structure to be formed in the opposite surface of the layer 33 (described below). Most preferably, the thickness of the reflection enhancing body should be at least the sum of the maximum profile depths of the first and second relief structures (i.e. at least $d_1+d_2$. For example, typical diffractive relief structures may have maximum profile depths of the order of 50 to 500 nm, more typically 50 to 150 nm, whilst the layer 33 will preferably have a thickness of at least 0.3 microns, more typically at least 1 micron. Where non-diffractive relief structures of larger dimensions are used, the layer 33 will be correspondingly thicker. Where the reflection enhancing body is made of more than one layer which each makes a significant contribution to its thickness, these preferred dimensions apply to the total thickness of the multiple layers making up the reflection enhancing body, e.g. $t_1+t_2$ in the present example. Preferred thickness dimensions of this sort also assist in ensuring that the layer 33 fully protects the underlying metal layer 34 during subsequent etching procedures. As mentioned above, optionally, once the reflective particle layer 33 has been laid down it may be partially cured, e.g. by radiation with UV. However, the material should remain formable.

In the next step S204, a second optically variable effect generating relief structure 36 is formed in the surface of layer 33 as shown in FIG. 9(*d*). Typically, this is achieved by a conventional embossing process under heat and pressure. If required, layer 33 may undergo curing during or after embossing of relief 36.

Next, in step S205, regions of metal layer 34 which are not covered by layer 33 are removed, typically by etching. As mentioned above, layer 33 acts as a etch resist and its extent therefore defines the final extent of metal layer 34. As such, the arrangement of layer 33 (e.g. the above described sun-shaped symbol) is exactly replicated in metal layer 33, as shown in FIG. 9(*e*).

It should be noted that steps S204 and S205 could be reversed in order, with the etching taking place before the second relief 36 is embossed.

The device shown in FIG. 9(*e*) is thus complete, with an optically variable effect being exhibited by each side of the device. As in the case of the first embodiment, subsequent processing steps represented by box S206 in FIG. 8 are optional and will depend on how the device is to be applied to or incorporated into a document of value or other object.

In a preferred example, as illustrated in FIG. 9(*f*), an optically transparent adhesive 38 is applied over the device for subsequent adhesion to a surface of a document or other object to be protected. As before, this could be omitted or the adhesive could be applied to the opposite side of the device or both sides of the device.

By using the reflective particle layer 33 as an etch resist, and only a single metallisation/demetallisation process, the method described with respect to FIGS. 8 and 9 results in exact alignment between the layers forming the reflection enhancing body 35, leading to exact registration between the optically variable regions viewable from each side of the device. This is extremely hard to imitate using other means and is therefore the preferred implementation.

However, in other embodiments the etching step could be omitted from the method, and FIG. 10 shows a fourth embodiment of a security device in accordance with the invention resulting from such a modified method. Again, the device 30' is shown fixed to a document 15 in a window region 16 and all of the labelled components are the same as those described with respect to FIG. 7 having the same reference numbers. In this example, the metal layer 34 extends across the full area of the device 30', whilst the reflective particle layer 33 is applied over a limited area, forming the same sun-shaped symbol as before.

When the device is viewed by observer A, as shown in FIG. 10(*i*), the whole of the (circular) device replays a first holographic image H1 and no additional detailing is visible. From the position of observer B, as depicted in FIG. 10(*ii*), the sun-shaped region formed by reflective particle layer 33 is visible and exhibits holographic image H2. In the regions of the device outside the sun shaped symbol, the colour of the metal layer 34 is visible and, if the metal layer replicates the relief structure 32 on both sides, portions of holographic image H1 may also be visible surrounding the sun-shaped region. It should be noted that if the colours of the metal layer 34 and metallic particle layer 32 are substantially the same, the boundaries of the sun-shaped region may not be readily apparent, with only the different holographic image H2 visually distinguishing the regions in which reflective particle layer 33 is present from its surroundings.

In embodiments such as that depicted in FIG. 10 it may be particularly preferable for metal layer 34 to be formed sufficiently thinly so as to be semi-transparent, in which case the sun-shaped feature formed by metallic particle layer 33 will be visible through metal layer 34 from the position of observer A. Formed as such, the appearance of the device may be similar to that of previous embodiments, with the relatively opaque, optically variable sun-shaped region dominating the appearance of the device from both sides, and its surroundings appearing substantially transparent. However, in this case an optically variable effect generated by relief structure 32 may continue to be visible outside the bounds of the sun-shaped feature. A semi-transparent reflective layer could be formed as an aluminium layer with a thickness of between 5 and 10 nm, for example.

In all of the embodiments described with respect to FIGS. 5 to 10, it will be noted that the two surfaces of reflective particle layer 23 or 33 forming all or part of the reflection enhancing body 23 or 35 follow different contours, which will generally be the case. Whilst the Figures depict each surface of the reflective particle layer 33 as following the two relief structures 32 and 36, where the reflection enhancing body comprises multiple layers, this need not be the case since the interface(s) between the various layers of the reflection enhancing body (e.g. between the two reflection enhancing layers 33 and 34) can follow any arbitrary contour. For example, FIG. 11 shows a fifth embodiment of a security device in accordance with the present invention made using the method described with respect to FIGS. 8 and 9, in which metal layer 34 has been applied to a thickness at which the troughs of the relief 32 are filled in, resulting in a substantially smooth surface carrying reflective particle layer 33. In this example, it is the total thickness t of the two layers making up reflective body 35 which should be arranged to be sufficient such that the relief structures 32, 36 do not interfere with one another, applying the considerations discussed previously.

In still further embodiments it should be noted that the reflection enhancing body 35 could incorporate additional layers in-between the two reflection enhancing layers described so far. Such intermediate layers will typically not contribute to the appearance of the device and could therefore be of any colour (transparent or opaque), and need not be reflective. In one example, an intermediate magnetic layer could be incorporated between the two reflection enhancing layers 33 and 34; optionally, this could be used to introduce additional coding (e.g. a spatial code) to the device which can be read using a magnetic reader. Alternatively, simply the presence of magnetic material could be used as a machine readable feature. The presence of the magnetic material will be concealed from the viewer by the reflection enhancing layers 33 and 34.

FIG. 12 schematically depicts an example of apparatus suitable for carrying out the method described with respect to FIGS. 8 and 9. A substrate web 39 is provided from a drum 41. The substrate web 49 may constitute a support layer such as layer 2 described with respect to FIG. 1, from which the security device will ultimately be detached, or could form an integral part of the final security device, article or document, in which case substrate 39 should be transparent at least in the regions where the security devices are to be applied, e.g. a web of polymer film such as BOPP. The substrate 39 is conveyed in this example through a first printing or coating station 42 in which a radiation curable resin is applied to the substrate 39, constituting transparent layer 31 of the device. The resin could be applied in patches or as a continuous, all over film. The substrate web 39 carrying transparent layer 31 is then held in contact with an embossing roller 43 equipped with an imprint of the desired relief structure 32. The relief structure 32 is cast into the resin layer 31, preferably in register with the applied patches of resin and simultaneously cured by the application of appropriate radiation, e.g. UV, represented by arrow R.

The substrate web 39, now carrying structures of the form shown for example in FIG. 9(*a*) is then conveyed into a metallisation chamber 44, in which a reflection enhancing layer 34 formed of metal is applied, e.g. by vacuum deposition. The metal layer 34 is applied all over the substrate web and the device structures it carries. Next, a second printing or coating station 45 is used to apply reflection enhancing layer 33, containing reflective particles, over reflection enhancing layer 34, e.g. by gravure printing. As described above, the reflective particle layer 33 is preferably laid down so as to define a decorative and/or secure shape such as indicia or a fine line pattern. Depending on the nature of the material used to form layer 33, the material may require partial curing prior to onward processing, and appropriate heating or irradiating apparatus may therefore be provided after print station 45 (not shown). The substrate web 39 is then conveyed through an embossing station 46, where the second relief structure 36 is impressed into reflective particle layer 33. Simultaneously or subsequently, the material may be fully cured to fix the relief structure. Finally, the substrate web 39 is conveyed through a removal chamber 47, e.g. an etchant tank, for removal of those regions of reflection enhancing layer 34 which are not masked by reflection enhancing layer 33. As previously mentioned, the etching could take place before the second relief is embossed into the device if preferred, in which case the order of stations 46 and 47 will be reversed.

At the output side of chamber 47, the substrate web will carry structures such as that shown in FIG. 9(*e*). The substrate web 39 may go onto additional processing steps such as the application of an transparent adhesive 38, cutting into individual security articles and/or direct incorporation into a security document, examples of which will be given below. For instance, where the substrate 39 is to form the substrate of the polymer (or polymer/paper composite) banknote, following etching the substrate may undergo further printing steps during which one or more opacifying layers may be applied to the substrate around the formed devices (if not already present on the substrate web), resulting in the devices being situated in window regions, followed by graphics printing and ultimately cutting into individual notes.

The apparatus depicted in FIG. 12 is an example of an inline manufacturing process and provides the advantage that the various printing and embossing steps can be carried out in register with one another. For instance, as mentioned above, the relief structures 32 on embossing cylinder 43 are preferably in register with the resin applied at print or coating station 42 and may also be in register with the reflective particle layer 33 applied at print/coating station 45. Preferably, the relief structures embossed at stations 43 and 46 will be in register with one another. By applying the features in register with one another, their relative positions will be substantially identical in each security device formed using the process.

It will be appreciated that where the relief structure 32 is to be formed directly in the surface of the substrate web 39, the first printing/coating station 42 can be omitted. Further, in this case, the relief 32 will typically be formed by conventional embossing using heat and pressure in which case embossing roller 43 may be replaced by a conventional embossing nip without any radiation means (akin to station 46). However, in some cases the polymeric substrate web 39 could itself include a radiation activated curing agent in order to promote hardening and retention of the relief structure once formed. In this case, appropriate radiation means may be retained.

An example of a security device according to a sixth embodiment of the invention in which the relief 32 is formed directly in the surface of a substrate 39 is depicted in FIG. 13. Here, substrate 39 is itself transparent and constitutes the first transparent layer. The relief structure 32, first reflection enhancing layer 33 and second reflection enhancing layer 34 are each formed in the same way as described above. The security device could be coated with a transparent adhesive in the same manner as previously described, e.g. if the structure shown is a security article such as a patch, thread or strip which is to be affixed to a security document or other object (substrate 39 acting as a protective cover layer). However, in this example the substrate 39 ultimately forms an integral part of a security document such as a polymer banknote and as such no adhesive layer is required. Instead, the device may be coated with a protective lacquer 37 or this function could be achieved by the reflective particle layer 33 itself, with layer 37 being omitted.

The security device could include additional layers to those described above, for example, protective lacquer layers could be applied to either side of the device which will typically be colourless although could if preferred include one or more colorants. The security device could additionally comprise one or more printed layers: for example, printed indicia could be applied before applying the reflective body to the first relief, or to the second surface of the reflective body before or after formation of the second relief. Typically, such printed indicia would be non-transparent meaning that the reflection enhancing body is obstructed locally, thereby masking the optically variable effect according to the shapes defined by the printed indicia. This could be used for example to display text, numbers or other symbols within the device.

The device could also incorporate one or more machine readable substances such as magnetic material. For instance, a transparent magnetic pigment could be incorporated into one or both of the transparent layers, optionally in accordance with a spatial code. This applies to all embodiments.

FIGS. 14, 15 and 16 depict examples of security documents in which security devices of the sorts described above have been incorporated. FIG. 14 shows a first exemplary security document, here a banknote 50, in (a) plan view and (b) cross-section along line XX'. Here, the banknote 50 is a polymer banknote, comprising an internal transparent polymer substrate 52 which is coated on each side with opacifying layers 53*a* and 53*b* in a conventional manner. In some cases, the opacifying layers may be provided on one side of the substrate 52 only. The opacifying layers 53*a* and 53*b* are omitted in a region of the document so as to define a window 51, here having a square shape. Within the window region 51 is located a security device 30 in accordance with any of the embodiments discussed above. The outer perimeter of the device 30 is denoted by the dashed circular line surrounding the "sun shaped" optically variable effect region. The security device 30 may be formed integrally in the banknote 50 with the relief structure 32 being formed directly in the surface of transparent substrate 52 in a manner akin to that depicted in FIG. 13. Alternatively, the security device 30 may have been formed separately as a security article such as a transfer patch or label, e.g. having the construction shown in FIG. 5. In this case, the security device 30 may be affixed to the transparent substrate 52 inside the window region 51 by means of the transparent adhesive 38. Application may be achieved by a hot or cold transfer method e.g. hot stamping.

It should be noted that a similar construction could be achieved using a paper/plastic composite banknote in which the opacifying layers 53*a* and 53*b* are replaced by paper layers laminated (with or without adhesive) to an internal transparent polymer layer 52. The paper layers may be omitted from the window region from the outset, or the paper could be removed locally after lamination. In other constructions, the order of the layers may be reversed with a (windowed) paper layer on the inside and transparent polymer layers on the outside.

In FIG. 15, the banknote 50 is of conventional construction having a substrate 54 formed for example of paper or other relatively opaque or translucent material. The window region 51 is formed as an aperture through the substrate 54. The security device 30 is applied as a patch overlapping the edges of window 51 utilising transparent adhesive 38 to join the security article to the document substrate 54. Again, the application of the security device and document could be achieved using various methods including hot stamping.

FIG. 16 depicts a third example of a security document, again a banknote 50, to which a security article 60 in the form of a security thread or security strip has been applied. Three security devices 30 each carried on the strip 60 are revealed through windows 51, arranged in a line on the document 50. Two alternative constructions of the document as shown in cross-section in FIGS. 16*b* and 16*c*. FIG. 16*b* depicts the security thread or strip 60 incorporated within the security document 50. For example, the security thread or strip 60 may be incorporated within the substrate's structure during the paper making process using well known techniques. To form the windows 51, the paper may be removed locally after completion of the paper making process, e.g. by abrasion. Alternatively, the paper making process could be designed so as to omit paper in the desired window regions. FIG. 16*c* shows an alternative arrangement in which the security thread or strip 60 carrying the security device 30 is applied to one side of document substrate 55, e.g. using adhesive. The windows 51 are formed by provision of apertures in the substrate 55, which may exist prior to the application of strip 60 or be formed afterwards, again for example by abrasion.

In each of the examples of FIGS. 14, 15 and 16, the security devices 30 are arranged in a window region 51 of the document 50 which constitutes a transparent portion of the document such that the devices 30 can be viewed from each side of the document at the same location. However, it is not essential that both sides of the same portion of the device be visible to an observer. In other cases, a first side of the device may be revealed at a first location on the document whilst the second side of the device may be revealed at a different location on the document. Examples of this sort will now be described with reference to FIGS. 17 and 18.

FIG. 17 shows an example of a security document 50 formed in a similar manner to that of FIG. 14. Here, the security device 30 has been formed directly on an embossing lacquer 70 coated onto document substrate 52. The device 30 may have a structure similar to that shown in FIG. 13 for example. The opacifying layers 53*a* and 53*b* have different extents on each side of the document such that the gaps in each opacifying layer do not overlap (in other cases some overlapping could be provided). This results in two "half-windows" 51*a* and 51*b*. In each half-window, only one side of the device is visible. From the front of the document (FIG. 17*a*), the device 30 can be viewed through half-window 51*a*, revealing a portion of the first optically variable effect (e.g. a holographic "star" image), as determined by the first relief structure in the manner discussed above. The device is not visible in the same location on the reverse side of the document, as represented by the dashed-line rectangle 51*a* in FIG. 17*b*. Conversely, on the reverse side of the note, the device 30 is visible through half-window 51*b*, and here a second optically variable effect (e.g. a holographic crossed-arrow symbol) will be visible as determined by the second relief structure, which is preferably different from the first. This portion of the device is not visible on the front side of the note.

In this example, the device 30 is one continuous device which extends across both half-window regions. However, in other cases, a plurality of separate security devices, each formed according to the principles described above, could be provided with the same results.

FIG. 18 depicts a further example of a security document 50 having a similar construction to that of FIG. 16, described above. Here, a series of security devices 30 are provided on a security thread or strip 60, which is incorporated into the document during the paper-making process. The document layers 55*a* and 55*b* falling on either side of the thread 60 are removed (or alternatively are not formed during the paper-making process) in regions to create half-windows 51*a* and 51*b* as well as a (full) window 51. Example methods of forming half-windows on either side of a paper document can be found for example in EP1567713 and EP229646. As shown in FIG. 18*a*, from the front side of the document, the security devices will be revealed in the two half-windows 51*a* as well as the window 51, having a first optically variable effect resulting from the first relief structure. From the reverse side (FIG. 18*b*), devices 30 will be revealed in different locations, namely half-window 51*b* and window 51 (which has the same location on the front side). From this view point, the devices will present a second, preferably different, optically variable effect, as determined by the second relief structure. In this example, the security devices 30 are provided as a series of separate, identical devices. However, the devices in the series could differ in their content (e.g. holographic image presented), colour (e.g. different second transparent layers) and/or construction. The plurality of devices (or a subset thereof) could also be replaced by a single continuous device as in FIG. 17.

Many alternative techniques for incorporating security documents of the sorts discussed above are known and could be used. For example, the above described device structures could be formed directly on other types of security document including identification cards, driving licenses, bankcards and other laminate structures, in which case the security device may be incorporated directly within the multilayer structure of the document.

The invention claimed is:

1. A security device comprising a transparent layer having a first optically variable effect generating relief structure formed in a surface thereof; a reflection enhancing body extending over the first relief structure and following the contour of the first relief on a first side of the reflection enhancing body; and a second optically variable effect generating relief structure formed in a second side of the reflection enhancing body, the reflection enhancing body comprising at least a first reflection enhancing layer defining the first and/or second sides of the reflection enhancing body, the first reflection enhancing layer comprising a binder having reflective particles dispersed therein, wherein when the device is viewed through the transparent layer, the optically variable effect of the first relief structure is visible and when the device is viewed from the other side, the optically variable effect of the second relief structure is visible.

2. A security device according to claim 1, wherein the thickness of the reflection enhancing body is sufficient that the first and second relief structures do not interfere with each other.

3. A security device according to claim 1, wherein the reflection enhancing body has a thickness greater than the maximum profile depths of each of the first and second relief structures.

4. A security device according to claim 1, wherein the lateral extent of the reflection enhancing body is less than the full area of the security device.

5. A security device according to claim 1, wherein the first reflection enhancing layer defines one of the first and second sides of the reflection enhancing body, and the reflection enhancing body further comprises a second reflection enhancing layer defining the other of the first and second sides.

6. A security device according to claim 5, wherein the lateral extent of the first reflection enhancing layer corresponds to that of the second reflection enhancing layer.

7. A security device according to claim 5, wherein the second reflection enhancing layer comprises any of:

one or more metals or alloys thereof;

an optical interference thin film structure;

a layer containing metallic particles, optically variable particles or optically variable magnetic particles;

a photonic crystal layer; or a liquid crystal layer.

8. A security device according to claim 5, wherein the first reflection enhancing layer comprises a resist material which is resistant to etchant suitable for removing material of the second reflection enhancing layer from the device.

9. A security device according to claim 5, wherein the visible colour of the first reflection enhancing layer is different from that of the second reflection enhancing layer at least under illumination at selected wavelengths, such that the optically variable effect of the first relief structure exhibits a different colour from that of the optically variable effect of the second relief structure.

10. A security device according to claim 1, wherein the reflection enhancing body comprises a screened working of discontinuous elements.

11. A security device according to claim 1, wherein the first reflection enhancing layer comprises a polymeric binder having reflective particles dispersed therein.

12. A security device according to claim 1, wherein the first reflection enhancing layer comprises a material with a forming temperature less than that of the transparent layer.

13. A security device according to claim 1, wherein the first reflection enhancing layer comprises two or more materials, each comprising a binder having reflective particles dispersed therein, the two or more materials being optically distinguishable from one another and arranged to define a pattern.

14. A security device according to claim 1, wherein the first optically variable effect generating relief structure is different from the second optically variable effect generating relief structure such that the first and second optically variable effects are different.

15. A security device according to claim 1, wherein the first and second optically variable effect generating relief structures each comprise any of: a diffractive structure from one of a hologram, a diffraction grating, or a Kinegram™; or a non-diffractive micro-optical structure.

16. A security device according to claim 1, wherein either the first transparent layer forms an integral part of a substrate, or the first transparent layer is disposed on a substrate.

17. A method of manufacturing a security device, comprising:

forming a first optically variable effect generating relief structure in a surface of a transparent layer;

applying a reflection enhancing body over the first relief structure such that a first side of the reflection enhancing body follows the contour of the first relief, the reflection enhancing body comprising at least a first reflection enhancing layer defining the first and/or second sides of the reflection enhancing body, the first reflection enhancing layer comprising a binder having reflective particles dispersed therein; and forming a second optically variable effect generating relief structure in the second side of the reflection enhancing body;

such that when the device is viewed through the transparent layer, the optically variable effect of the first relief structure is visible and when the device is viewed from the other side, the optically variable effect of the second relief structure is visible.

18. A method according to claim 17, wherein the thickness of the reflection enhancing body is sufficient that the first and second relief structures do not interfere with each other.

19. A method according to claim 17, wherein the reflection enhancing body has a thickness greater than the maximum profile depths of each of the first and second relief structures, preferably equal to or greater than the sum of the maximum profile depths of the first and second relief structures.

20. A method according to claim 17, wherein the reflection enhancing body is applied across less than the full area of the security device.

21. A method according to claim 17, wherein applying the reflection enhancing body comprises applying a second reflection enhancing layer over the first relief structure before or after applying the first reflection enhancing layer, such that the first reflection enhancing layer defines one of the first and second sides of the reflection enhancing body, and the second reflection enhancing layer defines the other of the first and second sides.

22. A method according to claim 21, wherein the second reflection enhancing layer comprises any of:

one or more metals or alloys thereof;

an optical interference thin film structure;

a layer containing metallic particles, optically variable particles or optically variable magnetic particles;

a photonic crystal layer; or a liquid crystal layer.

23. A method according to at least claim 21, further comprising:

after applying the first reflection enhancing layer, removing the material of the second reflection enhancing layer from regions of the device in which the second reflection enhancing layer is not covered by the first reflection enhancing layer, such that the lateral extent of the first and second reflection enhancing layers correspond.

24. A method according to claim 23, wherein the material of the second reflection enhancing layer is removed by etching, the first reflection enhancing layer acting as an etch resist.

25. A method according to at least claim 21, wherein the visible colour of the first reflection enhancing layer is different from that of the second reflection enhancing layer at least under illumination at selected wavelengths, such that the optically variable effect of the first relief structure exhibits a different colour from that of the optically variable effect of the second relief structure.

26. A method according to claim 17, wherein the first reflection enhancing layer is applied as a screened working of discontinuous elements.

27. A method according to claim 17, wherein the first reflection enhancing layer comprises a polymeric binder having reflective particles dispersed therein.

28. A method according to any of claim 17, wherein the first reflection enhancing layer comprises a material with a forming temperature less than that of the transparent layer.

29. A method according to claim 17, wherein the first reflection enhancing layer comprises a photoactive curing agent, the method further comprising partially curing the first reflection enhancing layer before forming the second optically variable relief structure and/or fully curing the first reflection enhancing layer after forming the second optically variable relief structure.

30. A method according to claim 17, wherein applying the first reflection enhancing layer comprises applying two or more materials, each comprising a binder having reflective particles dispersed therein, the two or more materials being optically distinguishable from one another and arranged to define a pattern.

31. A method according to claim 17, wherein the first optically variable effect generating relief structure is different from the second optically variable effect generating relief structure such that the first and second optically variable effects are different.

32. A method according to claim 17, wherein the first and second optically variable effect generating relief structures each comprise any of: a diffractive structure from one of a hologram, a diffraction grating or a Kinegram™; or a non-diffractive micro-optical structure.

33. A method according to any of claim 17, wherein the first and second optically variable effect generating relief structures are formed in register with one another.

34. A method according to claim 17, wherein the transparent layer either forms an integral part of a substrate, or the first transparent layer is disposed on a substrate.

35. A security device made in accordance with claim 17.

36. A security article comprising a security device according to claim 1.

37. A security document comprising a security device according to claim 1.

* * * * *